US012389940B2

(12) United States Patent
Zinovik

(10) Patent No.: US 12,389,940 B2
(45) Date of Patent: Aug. 19, 2025

(54) AEROSOL-GENERATING DEVICE AND SYSTEM WITH CONDUCTIVITY SENSOR

(71) Applicant: PHILIP MORRIS PRODUCTS S.A., Neuchatel (CH)

(72) Inventor: Ihar Zinovik, Peseux (CH)

(73) Assignee: Philip Morris Products S.A., Neuchatel (CH)

( * ) Notice: Subject to any disclaimer, the term of this patent is extended or adjusted under 35 U.S.C. 154(b) by 635 days.

(21) Appl. No.: 17/618,634

(22) PCT Filed: Jun. 24, 2020

(86) PCT No.: PCT/EP2020/067743
§ 371 (c)(1),
(2) Date: Dec. 13, 2021

(87) PCT Pub. No.: WO2020/260414
PCT Pub. Date: Dec. 30, 2020

(65) Prior Publication Data

US 2022/0232889 A1 Jul. 28, 2022

(30) Foreign Application Priority Data

Jun. 25, 2019 (EP) ..... 19182378

(51) Int. Cl.
*A24F 40/10* (2020.01)
*A24F 40/46* (2020.01)
*A24F 40/51* (2020.01)

(52) U.S. Cl.
CPC ..... *A24F 40/10* (2020.01); *A24F 40/46* (2020.01); *A24F 40/51* (2020.01)

(58) Field of Classification Search
CPC ..... A24F 40/10; A24F 40/46; A24F 40/51; A24F 40/42; A24F 40/50
See application file for complete search history.

(56) References Cited

U.S. PATENT DOCUMENTS

2015/0101625 A1* 4/2015 Newton ..... A24F 40/60 131/329
2015/0272220 A1* 10/2015 Spinka ..... A24F 40/60 131/329
2017/0231278 A1* 8/2017 Mironov ..... G01F 23/26 392/390
2018/0177229 A9* 6/2018 Reevell ..... A24F 40/51

FOREIGN PATENT DOCUMENTS

JP 2019-511202 4/2019
WO WO 2015/015431 2/2015
(Continued)

OTHER PUBLICATIONS

Emerson Process Management Application Data Sheet ADS 43-018/rev.D; https://www.emerson.com/documents/automation/application-data-sheet-theory-application-of-conductivity-rosemount-en-68442.pdf (Year: 2010).*

(Continued)

*Primary Examiner* — Philip Y Louie
*Assistant Examiner* — Jeffrey A. Buckman
(74) *Attorney, Agent, or Firm* — Mueting Raasch Group

(57) ABSTRACT

An aerosol-generating system comprising: a liquid storage portion for holding a liquid aerosol-forming substrate; an atomiser in fluid connection with the liquid storage portion; a conductivity sensor; a power supply; and control electronics. The conductivity sensor comprises at least two electrodes (104, 106) and is arranged to sense the electrical conductivity of liquid aerosol-forming substrate from the liquid storage portion. The control electronics are configured to: control a supply of power from the power supply to the atomiser for atomising liquid aerosol-forming substrate from the liquid storage portion; and control a supply of power from the power supply to the electrodes (104, 106) of the conductivity sensor, the supply of power being provided to the conductivity sensor as an alternating voltage. The control electronics are further configured to: receive one or more measurements indicative of the conductivity of the (Continued)

liquid aerosol-forming substrate from the conductivity sensor; and determine the nicotine concentration of the liquid aerosol-forming substrate based on one or more of the measurements from the conductivity sensor.

15 Claims, 9 Drawing Sheets

(56) References Cited

FOREIGN PATENT DOCUMENTS

| | | |
|---|---|---|
| WO | WO 2015/117702 | 8/2015 |
| WO | WO 2016/199065 | 12/2016 |
| WO | WO 2017/137505 | 8/2017 |
| WO | WO 2017/137510 | 8/2017 |
| WO | WO 2019/002377 | 1/2019 |
| WO | WO 2020/259961 | 12/2020 |
| WO | WO 2020/259973 | 12/2020 |
| WO | WO 2020/259977 | 12/2020 |
| WO | WO 2020/260416 | 12/2020 |

OTHER PUBLICATIONS

PCT International Search Report and Written Opinion for PCT/EP2020/067743 dated Aug. 28, 2020 (9 pages).
Extended European Search Report for Application No. 19182378.0 dated Jan. 17, 2020.
Office Action issued in Japan for Application No. 2021-576707 dated Feb. 18, 2025 (2 pages).

* cited by examiner

AEROSOL-GENERATING DEVICE AND SYSTEM WITH CONDUCTIVITY SENSOR

This application is a U.S. National Stage Application of International Application No. PCT/EP2020/067743 filed Jun. 24, 2020, which was published in English on Dec. 30, 2020, as International Publication No. WO 2020/260414 A1. International Application No. PCT/EP2020/067743 claims priority to European Application No. 19182378.0 filed Jun. 25, 2019.

The present invention relates to an aerosol-generating system that atomises an aerosol-forming substrate comprising nicotine to generate an aerosol. In particular, the invention relates to an aerosol-generating system comprising a conductivity sensor. The present invention also relates to an aerosol-generating device comprising a conductivity sensor and a cartridge comprising a conductivity sensor.

Aerosol-generating systems, such as e-cigarettes, that operate by heating a liquid formulation to generate an aerosol for inhalation by users are widely used. Typically these systems comprises a liquid storage portion holding the liquid formulation, a heater for vaporising the liquid formulation, a wick that transports the liquid from the liquid storage portion to the heater, a power supply and control electronics. Some of these systems comprise a liquid storage portion that is refillable. Some of these systems comprise a device portion and a replaceable cartridge. In some systems, the device portion contains a power supply and control electronics and the cartridge contains a liquid storage portion holding the liquid formulation, a heater for vaporising the liquid formulation, and a wick that transports the liquid from the liquid storage portion to the heater.

In systems comprising a refillable liquid storage portion, liquid formulations having different compositions may be introduced into the liquid storage portion with the liquid storage portion is refilled. Similarly, in systems comprising a device portion and a replaceable cartridge, different cartridges may contain liquid formulations having different compositions. In particular, different liquid formulations may comprise different amounts or concentrations of nicotine. Accordingly, an aerosol generated from one particular liquid formulation may comprise a different amount or concentration of nicotine than an aerosol generated from a different liquid formulation.

It would be desirable for an aerosol-generating system to be able to evaluate the nicotine concentration of a liquid formulation. It would also be desirable for an aerosol-generating system to be able to control the nicotine concentration of aerosols generated from different liquid formulations. It would also be desirable to be able to standardise manufacture of an aerosol-generating system, regardless of the aerosol-forming substrate that is to be used with the aerosol-generating system.

According to the present disclosure, there is provided an aerosol-generating system comprising: a liquid storage portion for holding a liquid aerosol-forming substrate; an atomiser in fluid connection with the liquid storage portion; a conductivity sensor; a power supply; and control electronics. The conductivity sensor comprises at least two electrodes and is arranged to sense the electrical conductivity of liquid aerosol-forming substrate from the liquid storage portion. The control electronics are configured to: control a supply of power from the power supply to the atomiser for atomising liquid aerosol-forming substrate from the liquid storage portion; and control a supply of power from the power supply to the electrodes of the conductivity sensor, the supply of power being provided to the conductivity sensor as an alternating voltage. The control electronics are further configured to: receive one or more measurements indicative of the conductivity of the liquid aerosol-forming substrate from the conductivity sensor; and determine the nicotine concentration of the liquid aerosol-forming substrate based on one or more of the measurements from the conductivity sensor.

A liquid aerosol-forming substrate may comprise three main constituents, typically nicotine, an aerosol former and water. Advantageously, the inventors have realised that the electrical conductivity of a liquid aerosol-forming substrate may provide an indication of the nicotine concentration of the liquid aerosol-forming substrate. In particular, the inventors have realised that a manufacturer of an aerosol-generating device may also manufacture or sell proprietary liquid aerosol-forming substrates having different nicotine concentrations, and that providing an aerosol-generating device with a conductivity sensor may enable the device to determine which proprietary aerosol-forming substrate is received in the device based on the electrical conductivity of the aerosol-forming substrate.

As used herein, the term 'aerosol-forming substrate' refers to a substrate capable of releasing volatile compounds that can form an aerosol. The volatile compounds may be released by heating the aerosol-forming substrate. The volatile compounds may be released by moving the aerosol-forming substrate through passages of a vibratable element.

The aerosol-forming substrate is a liquid aerosol-forming substrate. The aerosol-forming substrate may comprise a mixture of liquid and solid components. The aerosol-forming substrate comprises nicotine. Preferably, the aerosol-forming substrate comprises a nicotine salt. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants.

In some preferred embodiments, the nicotine is in the form of a nicotine salt. In some particularly preferred embodiments, the nicotine salt may be the only electrolyte present in liquid aerosol-forming substrate. In some embodiments, the nicotine electrolyte concentration may be substantially higher than the concentration of other electrolytes in the liquid aerosol-forming substrate. Accordingly, it may be possible to ignore the effect of the variation in concentration of other components of the liquid aerosol-forming substrate on the electrical conductivity of the substrate.

A manufacturer of liquid aerosol-forming substrates may manufacture different proprietary aerosol-forming substrates having different concentrations of nicotine. To vary the concentration of nicotine in an aerosol-forming substrate, a manufacturer may increase or decrease the amount of nicotine in a given amount of the substrate by conversely decreasing or increasing the amount of solvent, such as water, in a given amount of the substrate. For example, a manufacturer may produce a low nicotine aerosol-forming substrate comprising a first amount of nicotine and a first amount of water for a given amount of substrate, and a high nicotine aerosol-forming substrate comprising a second amount of nicotine, greater than the first amount of nicotine, and a second amount of water, less than the first amount of water, for a given amount of substrate. The low nicotine aerosol-forming substrate may have a lower concentration of nicotine than the high nicotine aerosol-forming substrate. The low nicotine aerosol-forming substrate may have a first electrical conductivity and the high nicotine aerosol-forming substrate may have a second electrical conductivity, greater than the first electrical conductivity. The difference between the first electrical conductivity and the second electrical conductivity may increase with temperature.

A liquid aerosol-forming substrate may typically have an electrical conductivity at 20 degrees Celsius of between about 1 micro Siemen per centimetre and about 500 micro Siemen per centimetre, and preferably an electrical conductivity at 20 degrees Celsius of between about 1 micro Siemen per centimetre and about 400 micro Siemen per centimetre. Preferably, the conductivity sensor is suitable for measuring electrical conductivities of aerosol-forming substrates within these ranges.

The conductivity sensor may be any suitable type of sensor for sensing the electrical conductivity of liquid aerosol-forming substrate in the system.

The conductivity sensor may be arranged at any suitable location in the aerosol-generating system. The conductivity sensor may be arranged in the liquid storage portion. The conductivity sensor may be arranged at or around the liquid storage portion. The conductivity sensor may be arranged at or around the atomiser. The conductivity sensor may be arranged between the liquid storage portion and the atomiser. In some embodiments, the conductivity sensor is a separate component from the atomiser. In some preferred embodiments, the atomiser comprises the conductivity sensor. In these preferred embodiments, the atomiser may comprise one or more elements and at least one of the electrodes of the conductivity sensor comprises an element of the atomiser.

The electrodes of the conductivity sensor may have any suitable form. For example, the electrodes may be coil electrodes, ring electrodes or mesh electrodes comprising a plurality of filaments. In some embodiment, the electrodes may be arranged to contact liquid aerosol-forming substrate. In some embodiment, the electrodes may be arranged such that the electrodes do not contact the liquid aerosol-forming substrate. In other words, the electrodes may be isolated from the liquid aerosol-forming substrate.

In some first preferred embodiments, the conductivity sensor comprises two electrodes. The conductivity sensor of these first preferred embodiments may be referred to as a two-point conductivity sensor.

The two electrodes may be spaced apart such that a cavity is formed between the electrodes. For example, the two electrodes may be spaced apart by a distance of between about 1 millimetre and about 20 millimetres. As used herein, the term "cavity" refers to any suitable gap or space between the two electrodes, including both a two dimensional space between two completely flat electrodes arranged in the same plane and a three dimensional space between two electrodes. The two electrodes may be arranged such that liquid aerosol-forming substrate may be disposed in the cavity between the electrodes. Preferably, the two electrodes are arranged in contact with liquid aerosol-forming substrate from the liquid storage portion. The two electrodes may be arranged such that the two electrodes are electrically insulated from each other when liquid aerosol-forming substrate is not disposed in the cavity between the electrodes.

In these first preferred embodiments, the control electronics may be configured to supply the power from the power supply to the electrodes as an alternating voltage. The control electronics may also be configured to receive the one or more measurements indicative of the conductivity of the liquid aerosol-forming substrate from the electrodes.

In these first preferred embodiments, when liquid aerosol-forming substrate is disposed in the cavity between the electrodes, applying an alternating voltage across the two electrodes may cause an alternating current to flow between the two electrodes, through the liquid aerosol-forming substrate in the cavity between the electrodes. The control electronics may be configured to measure the current between the two electrodes. The control electronics may be configured to measure the voltage between the two electrodes. One or more of the measured current and voltage may be used to determine the electrical conductivity of the liquid aerosol-forming substrate disposed in the cavity between the two electrodes.

In these first preferred embodiments, the control electronics may be configured to supply an alternating voltage to the conductivity sensor at a frequency of between about 1 kHz and about 500 kHz.

In some second preferred embodiments, the conductivity sensor comprises four electrodes. The conductivity sensor of these second preferred embodiments may be referred to as a four-point conductivity sensor.

The conductivity sensor may comprise two inner electrodes and two outer electrodes. The two outer electrodes may be spaced apart such that an outer cavity is formed between the two outer electrodes. For example, the two outer electrodes may be spaced apart by a distance of between about 5 millimetres and about 20 millimetres. The two inner electrodes may be spaced apart to form an inner cavity between the two inner electrodes. For example, the two inner electrodes may be spaced apart by a distance of between about 5 millimetres and about 20 millimetres. In some embodiments, the two inner electrodes are arranged in the outer cavity between the two outer electrodes. In these embodiments, the two inner electrodes may be spaced apart by a distance of between about 1 millimetre and about 18 millimetres.

The two outer electrodes may be arranged such that liquid aerosol-forming substrate may be disposed in the outer cavity between the two outer electrodes. The two outer electrodes may be arranged such that the two outer electrodes are electrically insulated from each other when liquid aerosol-forming substrate is not disposed in the outer cavity between the outer electrodes.

The two inner electrodes may be arranged such that liquid aerosol-forming substrate may be disposed in the inner cavity between the two inner electrodes. The two inner electrodes may be arranged such that the two inner electrodes are electrically insulated from each other when liquid aerosol-forming substrate is not disposed in the inner cavity between the inner electrodes. The two inner electrodes may also be arranged such that the two inner electrodes are electrically insulated from the two outer electrodes when liquid aerosol-forming substrate is not disposed in the inner cavity between the inner electrodes.

Preferably, the two outer electrodes and the two inner electrodes are arranged in contact with liquid aerosol-forming substrate from the liquid storage portion.

In these second preferred embodiments, the control electronics may be configured to supply power from the power supply to the outer electrodes as an alternating voltage. The control electronics may be configured to receive one or more measurements indicative of the conductivity of the liquid aerosol-forming substrate from the outer electrodes. The control electronics may be configured to receive one or more measurements indicative of the conductivity of the liquid aerosol-forming substrate from the inner electrodes.

In these second preferred embodiments, when liquid aerosol-forming substrate is disposed in the outer cavity between the two outer electrodes, applying an alternating voltage across the two outer electrodes may cause an alternating current to flow between the two outer electrodes, through the liquid aerosol-forming substrate disposed in the outer cavity. When liquid aerosol-forming substrate is disposed in the outer cavity, liquid aerosol-forming substrate is also disposed in the inner cavity between the two inner electrodes. When an alternating current flows between the two outer electrodes, the alternating current also flows between the two inner electrodes establishing an alternating voltage across the two inner electrodes.

The control electronics may be configured to measure the voltage drop between the two inner electrodes. The measured voltage drop between the two inner electrodes may be used to determine the electrical conductivity of the liquid aerosol-forming substrate disposed in the inner cavity between the two inner electrodes. The control electronics may be configured to measure the current between the two outer electrodes. The measured current between the two outer electrodes may be used to determine the electrical conductivity of the liquid aerosol-forming substrate disposed in the outer cavity. In some particularly preferred embodiments, the control electronics are configured to use the measured voltage drop between the two inner electrodes and the measured current between the two outer electrodes to determine the electrical conductivity of the liquid aerosol-forming substrate. The electrical conductivity of the liquid aerosol-forming substrate may be proportional to the applied current.

Advantageously, a four-point conductivity sensor may minimise the effects of parasitic resistances on voltage measurements by the conductivity sensor. Parasitic resistances in the conductivity sensor, such as the contact resistances between the leads in contact with the electrodes, may cause errors in the voltage measurements. Advantageously, the four electrode arrangement of the second preferred embodiments enables the voltage measurements to be separated from the current measurements. Separating the voltage measurements from the current measurements may enable the effects of parasitic resistances on the voltage measurements to be minimised.

In the four-point conductivity sensors of the second preferred embodiments, the inner electrodes are arranged such that the current between the inner electrodes is substantially the same as the current driven between the outer electrodes. If the voltage across the inner electrodes is measured with a high impedance, a negligible current may be drawn through the leads connected to the inner electrodes in comparison to the current between the inner electrodes. Since the current through the leads connected to the inner electrodes is negligible in comparison to the current between the inner electrodes, the voltage drop across the leads connected to the inner electrodes resulting from parasitic resistances may be negligible in comparison to the voltage drop across the inner electrodes. As a result, measurements of the voltage across the inner electrodes may include minimal or negligible contributions from parasitic resistances.

In addition, as the measurements of voltage across the two inner electrodes draw a negligible current, polarisation of the liquid aerosol-forming substrate at the two inner electrodes may also be negligible, minimising the effects of polarisation on the voltage measurements in the four electrode arrangement of the second preferred embodiments.

In these second preferred embodiments, the control electronics may be configured to supply an alternating voltage to the conductivity sensor at a frequency of between about 1 kHz and about 500 kHz.

In some of these second preferred embodiments, the two inner electrodes may be susceptor elements. As used herein, the term 'susceptor element' refers to an element comprising a material that is capable of converting electromagnetic energy into heat. When a susceptor element is located in an alternating electromagnetic field, the susceptor is heated. Heating of a susceptor element may be the result of at least one of hysteresis losses and eddy currents induced in the susceptor, depending on the electrical and magnetic properties of the susceptor material. Accordingly, application of an alternating voltage to the two outer electrodes to heat the outer electrodes may induce a current in the two inner electrodes. The current induced in the two inner electrodes may be sufficient to heat the two inner electrodes.

A susceptor element may comprise any suitable material. The susceptor element may be formed from any material that can be inductively heated to a temperature sufficient to release volatile compounds from the aerosol-forming substrate. Suitable materials for the elongate susceptor element include graphite, molybdenum, silicon carbide, stainless steels, niobium, aluminium, nickel, nickel containing compounds, titanium, and composites of metallic materials. Preferred susceptor elements comprise a metal or carbon. Advantageously the susceptor element may comprise or consist of a ferromagnetic material, for example, ferritic iron, a ferromagnetic alloy, such as ferromagnetic steel or stainless steel, ferromagnetic particles, and ferrite.

In some third preferred embodiments, the conductivity sensor comprises two electrodes, a first electrode and a second electrode. Preferably, each electrode forms a coil. The first electrode is arranged to induce a current in the second electrode when an alternating voltage is supplied to the first electrode. The two electrodes may be spaced apart such that a cavity is formed between the electrodes. The two electrodes may be arranged such that the two electrodes are electrically insulated from each other.

Where the first and second electrodes form coils, the first electrode coil may be wound around a first inner cavity. The second electrode coil may be wound around a second inner cavity. The first electrode and the second electrode may be arranged such that the first inner cavity is aligned with the second inner cavity. The first inner cavity and the second inner cavity may define an inner cavity. The inner cavity may define a passage through which liquid aerosol-forming substrate may flow.

The conductivity sensor of these third preferred embodiments may be referred to as an inductive conductivity sensor.

In these third preferred embodiments, the control electronics may be configured to supply an alternating voltage to the first electrode. The control electronics may be further configured to receive the one or more measurements indicative of the conductivity of the liquid aerosol-forming substrate from the second electrode.

In these third preferred embodiments, when liquid aerosol-forming substrate is disposed in the inner cavity between the first electrode and the second electrode, applying an alternating voltage to the first electrode may cause an alternating current to be generated in the second electrode, via induction. The alternating voltage applied to the first electrode generates a fluctuating magnetic field, which causes a current to flow through the liquid aerosol-forming substrate disposed in the inner cavity. The magnitude and direction of the electrical current flowing through the liquid aerosol-forming substrate disposed in the inner cavity affects the alternating current generated in the second electrode. The control electronics may be configured to measure the current or the voltage induced in the second electrode. The measured current or voltage may be used to determine the electrical conductivity of the liquid aerosol-forming substrate disposed in the inner cavity between the first and second electrodes. The current induced in the second electrode may be proportional to the electrical conductivity of the liquid aerosol-forming substrate.

In these third preferred embodiments, the first and second electrodes may be shielded or isolated from the aerosol-forming substrate. In other words, the first and second electrodes may be arranged such that the first and second electrodes do not come into contact with the liquid aerosol-forming substrate. The first and second electrodes may be arranged in a conductivity sensor housing. The conductivity sensor housing may define the inner cavity, including the first inner cavity and the second inner cavity. The conductivity sensor housing may be made from any suitable material. The conductivity sensor housing may be made from a material that is substantially impermeable to the liquid aerosol-forming substrate. The conductivity sensor housing may be made from an electrically insulating material. For example, suitable electrically insulating materials include glasses, plastics and ceramic materials. As used herein, an electrically insulating material refers to a material having a volume resistivity at 20° C. of greater than about $1\times10^{6}$ Ωm, typically between about $1\times10^{9}$ Ωm and about $1\times10^{21}$ Ωm.

Inductive conductivity sensors may be arranged in any suitable location in the aerosol-generating system. Preferably, inductive conductivity sensors are arranged in the liquid storage portion. Preferably, inductive conductivity sensors are arranged in the liquid storage portion and liquid aerosol-forming substrate held in the liquid storage portion is able to flow through the inner cavity between the first and second electrodes.

In these third preferred embodiments, the control electronics may be configured to supply an alternating voltage to the conductivity sensor at a frequency of between about 1 MHz and about 100 MHz.

In these third preferred embodiments, the first electrode coil may have any suitable number of turns. The second electrode coil may have any suitable number of turns. Preferably, the second electrode coil has the same number of turns as the first electrode coil. The first electrode coil may have any suitable form. For example, the first electrode coil may be a spiral coil or a toroid. The second electrode coil may have any suitable form. For example, the second electrode coil may be a spiral coil or a toroid. Preferably the second electrode coil has the same form as the first electrode coil. Particularly preferably the first electrode coil and the second electrode coil comprise identical toroids.

The control electronics control a supply of power from the power supply to the electrodes of the conductivity sensor. The supply of power provided to the conductivity sensor is provided as an alternating voltage. The alternating voltage may be supplied to the electrodes of the conductivity sensor at any suitable frequency.

The control electronics are configured to determine the nicotine concentration of the liquid aerosol-forming substrate based on one or more of the measurements from the conductivity sensor. The control electronics may be configured to determine the nicotine concentration in any suitable manner. In one example, a predetermined functional relationship between electrical conductivity and nicotine concentration may be known. An appropriate algorithm may be stored in a memory of the control electronics, and the control electronics may be configured to calculate the nicotine concentration by applying the measurements of conductivity to the stored algorithm. In another example, predetermined aerosol-forming substrate electrical conductivity values for known nicotine concentrations may be stored in a look-up table in a memory of the control electronics, and measurements of electrical conductivity may be compared to the stored values of electrical conductivity to determine the nicotine concentration of the aerosol-forming substrate. The predetermined aerosol-forming substrate conductivity values for known nicotine concentrations may be determined by calibration, typically performed in the factory before the aerosol-generating system is provided to a user for use.

It will be appreciated that the determination of an indication of the concentration of nicotine in the liquid aerosol-forming substrate may not necessarily involve a calculation of a nicotine concentration value or involve stored values of nicotine concentration in a look-up table stored in a memory of the control electronics. For example, in some embodiments according to the present invention the determination of nicotine concentration in the liquid aerosol-forming substrate comprises the use of measurements of electrical conductivity to determine a particular power to supply to the atomiser. In these embodiments, the determination of the power to supply to the atomiser using the measurements of electrical conductivity is based on a predetermined relationship between nicotine concentration and electrical conductivity of the liquid aerosol-forming substrate.

In some embodiments, the control electronics are further configured to control the supply of power from the power supply to the atomiser for atomising the liquid aerosol-forming substrate based on the determined nicotine concentration of the liquid aerosol-forming substrate. Advantageously, this may enable the aerosol-generating system to control the amount of aerosol generated by the system based on the nicotine concentration of the aerosol-forming substrate.

Preferably, the control electronics are configured to control the supply of power from the power supply to the atomiser for atomising the liquid aerosol-forming substrate based on the determined nicotine concentration of the liquid aerosol-forming substrate by comparing the determined nicotine concentration to a predetermined threshold. The control electronics may be further configured to supply a first power to the atomiser when the determined nicotine concentration is equal to or below the predetermined threshold. The control electronics may be further configured to supply a second power to the atomiser, lower than the first power, when the determined nicotine concentration exceeds the predetermined threshold. Such a configuration may generate a relatively large amount of aerosol during a user experience when the determined concentration of nicotine is relatively low, and may generate a relatively small amount of aerosol when the determine concentration of nicotine is relatively high. Varying the amount of aerosol generated in a user experience may vary the amount of nicotine delivered to a user during a user experience. Advantageously, this may enable aerosol-generating system to deliver a consistent amount of nicotine to a user during a user experience regardless of the nicotine concentration of the liquid aerosol-forming substrate.

The control electronics may be configured to control the power supplied from the power supply to the atomiser in discrete increments. For example, a plurality of discrete power settings may be stored in a lookup-table in a memory of the control electronics, each power setting being associated with a particular predetermined nicotine concentration and electrical conductivity, and the control electronics may be configured to compare a conductivity measurement to the stored electrical conductivity values in the look-up table and apply power from the power supply to the atomiser based on the power setting associated with the stored electrical conductivity value that matches the conductivity measurement.

The control electronics may be configured to control the power supplied from the power supply to the atomiser continuously. The control electronics may be configured to control the power supplied from the power supply to the atomiser as a function of the electrical conductivity. A predetermined algorithm may be stored on a memory of the control electronics and conductivity measurements may be applied to the predetermined algorithm to determine the power to be supplied from the power supply to the atomiser.

The control electronics may be configured to supply power from the power supply to the electrodes of the conductivity sensor at any suitable time. Preferably, the control electronics is configured to supply power from the power supply to the electrodes of the conductivity sensor before power is supplied from the power supply to the atomiser for atomising liquid aerosol-forming substrate. Advantageously, this may enable the control electronics to control the power supplied from the power supply to the atomiser based on the determined nicotine concentration of the liquid aerosol-forming substrate.

The electrical conductivity of the liquid aerosol-forming substrate may vary depending on the temperature of the aerosol-forming substrate.

In some embodiments the aerosol-generating device may comprise a temperature sensor. The control electronics may be configured to receive one or more temperature measurements from the temperature sensor. The control electronics may be further configured to adjust the determination of the nicotine concentration based on one or more of the temperature measurements from the temperature sensor.

The temperature sensor may be any suitable type of temperature sensor for sensing the temperature of the liquid aerosol-forming substrate. Suitable types of temperature sensor include, amongst others, thermocouples, thermistors and resistive temperature sensors.

The temperature sensor may be arranged to sense the temperature of the liquid aerosol-forming substrate. The temperature sensor may be arranged at any suitable location relative to the conductivity sensor. Preferably, the temperature sensor is arranged at or around the conductivity sensor to minimise the temperature difference between the liquid aerosol-forming substrate sensed by the temperature sensor and the liquid aerosol-forming substrate sensed by the conductivity sensor. The temperature sensor may be arranged in the liquid storage portion. The temperature sensor may be arranged at or around the atomiser. The temperature sensor may be arranged between the liquid storage portion and the atomiser. In some embodiments, the temperature sensor is a separate component from the atomiser. In some embodiments, the atomiser comprises the temperature sensor.

The control electronics may adjust the determination of the nicotine concentration based on the temperature measurements in any suitable manner.

In one example, a predetermined functional relationship between temperature and electrical conductivity is known. An algorithm may be stored in a memory of the control electronics, and the control electronics may be configured to calculate the nicotine concentration by applying the measurements of conductivity and temperature to the stored algorithm.

In another example, predetermined aerosol-forming substrate electrical conductivity values, at particular temperatures, for known nicotine concentrations may be stored in a look-up table in a memory of the control electronics, and measurements of electrical conductivity and temperature may be compared to the stored values of electrical conductivity and temperature to determine the nicotine concentration of the aerosol-forming substrate.

In some embodiments, the aerosol-generating system may comprise a heater. The heater may be arranged to heat liquid aerosol-forming substrate from the liquid storage portion. The heater may be configured to heat liquid aerosol-forming substrate to a predetermined temperature. The power supply may be configured to supply power to the heater. The control electronics may be configured to supply power from the power supply to the heater to heat liquid aerosol-forming substrate from the liquid storage portion to a predetermined temperature.

The heater may be arranged at any suitable location relative to the conductivity sensor. Preferably, the heater is arranged at or around the conductivity sensor to minimise the temperature difference between the liquid aerosol-forming substrate heated by the heater and the liquid aerosol-forming substrate sensed by the conductivity sensor. The heater may be arranged in the liquid storage portion. The heater may be arranged at or around the atomiser. The heater may be arranged between the liquid storage portion and the atomiser. Typically the heater is arranged upstream of the conductivity sensor, such that the heater may heat the liquid aerosol-forming substrate to the predetermined temperature before the liquid aerosol-forming substrate reaches the conductivity sensor. In some embodiments, the heater is a separate component from the atomiser. In some embodiments, the atomiser comprises the heater.

The control electronics may be configured to supply power from the power supply to the heater at any suitable time. In some embodiments, the control electronics are configured to continuously supply power from the power supply to the heater to maintain the temperature of the liquid aerosol-forming substrate at the predetermined temperature. In some embodiments, the control electronics is configured to supply power from the power supply to the heater for a predetermined period of time before a conductivity measurement is taken to ensure that the liquid aerosol-forming substrate has sufficient time to reach the predetermined temperature before the conductivity measurement is taken.

The predetermined temperature may be any suitable temperature. Typically, the predetermine temperature is above expected ambient temperatures, such that the ambient temperature does not affect the temperature of the liquid aerosol-forming substrate at the conductivity sensor. For example, the predetermined temperature may be at least about 60 degrees Celsius, at least about 70 degrees Celsius, or at least about 80 degrees Celsius. The predetermined temperature is below the boiling point of the liquid aerosol-forming substrate.

In embodiments comprising a heater for heating the aerosol-forming substrate to a predetermined temperature, it may not be necessary to provide a temperature sensor for sensing the temperature of the liquid aerosol-forming substrate, as it may be reasonable to assume that the temperature of the liquid aerosol-forming substrate sensed by the conductivity sensor is at the predetermined temperature.

The aerosol-generating system may comprise a housing. The housing may be formed from any suitable material or combination of materials. Suitable materials include, but are not limited to, aluminium, polyether ether ketone (PEEK), polyimides, such as Kapton®, polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), epoxy resins, polyurethane resins, vinyl resins, liquid crystal polymers (LCP) and modified LCPs, such as LCPs with graphite or glass fibres.

The housing may define the liquid storage portion. The liquid storage portion may be any suitable shape and size for holding sufficient liquid aerosol-forming substrate for multiple user experiences. For example, the liquid storage portion may have sufficient capacity to allow for the continuous generation of aerosol for a period of around six minutes or for a period that is a multiple of six minutes. In another example, liquid storage portion may have sufficient capacity to allow for a predetermined number of puffs or discrete activations of the atomiser.

In some embodiments, a porous carrier material may be provided in the liquid storage portion. The liquid aerosol-forming substrate may be sorbed or otherwise loaded on the porous carrier material. The porous carrier material may be made from any suitable absorbent plug or body. For example, a suitable absorbent plug or body may be a foamed metal or plastics material, polypropylene, terylene, nylon fibres or ceramic.

The aerosol-generating system may further comprise a liquid transfer element. The liquid transfer element may be configured so that, in use, liquid aerosol-forming substrate is transported by capillary action along the liquid transfer element from the liquid storage portion to the atomiser. In embodiments in which the liquid storage portion comprises a porous carrier material, the liquid transfer element is configured to transport liquid aerosol-forming substrate from the porous carrier material to the atomiser. The liquid transfer element may comprise a capillary material. A capillary material is a material that actively conveys liquid from one end of the material to another. The capillary material may be advantageously oriented in the liquid storage portion to convey liquid aerosol-forming substrate to the atomiser.

The liquid transfer element may comprise any suitable material or combination of materials which is able to convey the liquid aerosol-forming substrate along its length. The liquid transfer element may be formed from a porous material, but this need not be the case. The liquid transfer element may be formed from a material having a fibrous or spongy structure. The liquid transfer element preferably comprises a bundle of capillaries. For example, the liquid transfer element may comprise a plurality of fibres or threads or other fine bore tubes. The liquid transfer element may comprise sponge-like or foam-like material. Preferably, the structure of the liquid transfer element forms a plurality of small bores or tubes, through which the liquid aerosol-forming substrate can be transported by capillary action. The particular preferred material or materials will depend on the physical properties of the liquid aerosol-forming substrate. Examples of suitable capillary materials include a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres, ceramic, glass fibres, silica glass fibres, carbon fibres, metallic fibres of medical grade stainless steel alloys such as austenitic 316 stainless steel and martensitic 440 and 420 stainless steels. The liquid transfer element may have any suitable capillarity so as to be used with different liquid physical properties. The liquid aerosol-forming substrate has physical properties, including but not limited to viscosity, surface tension, density, thermal conductivity, boiling point and vapour pressure, which allow the liquid aerosol-forming substrate to be transported through the liquid transfer element. The liquid transfer element may be formed from heat-resistant material. The liquid transfer element may comprise a plurality of fibre strands. The plurality of fibre strands may be generally aligned along a length of the liquid transfer element.

In embodiments in which the liquid storage section comprises a porous carrier material, the porous carrier material and the liquid transfer element may comprise the same material. Preferably, the porous carrier material and the liquid transfer element comprise different materials.

The atomiser may be any suitable type of atomiser. For example, the atomiser may be a sonic atomiser. A sonic atomiser may release volatile compounds from an aerosol-forming substrate by moving the aerosol-forming substrate through a plurality of nozzles using vibrations, typically at ultrasonic frequencies. In another example, the atomiser may be a thermal atomiser. A thermal atomiser may release volatile compounds from an aerosol-forming substrate by heating the aerosol-forming substrate.

In some embodiments, the atomiser comprises the conductivity sensor. In these embodiments, the atomiser may comprise one or more electrically conductive elements. One or more of the electrodes of the conductivity sensor may comprise one or more of the electrically conductive elements of the atomiser. Advantageously combining the atomiser and the conductivity sensor may reduce the number of components of the aerosol-generating system, reducing cost and complexity of manufacture.

In some preferred embodiments, the atomiser is a thermal atomiser. The thermal atomiser may be an electric heater. The thermal atomiser may comprise one or more heating elements. Preferably, the thermal atomiser comprises a plurality of heating elements.

In some particularly preferred embodiments, the atomiser is a thermal atomiser comprising a plurality of heating elements and each of the electrodes of the conductivity sensor comprises a heating element of the thermal atomiser. In these particularly preferred embodiments, the control electronics may be further configured to supply a first power from the power supply to the electrodes of the conductivity sensor for measuring the conductivity of the liquid aerosol-forming substrate; and supply a second power from the power supply to the plurality of heating elements of the atomiser for atomising the liquid aerosol-forming substrate. The second power is greater than the first power. The first power may be sufficient to enable an electrical conductivity measurement to be received at the control electronics from the conductivity sensor without raising the temperature of the heating elements to a sufficient temperature to release volatile compounds from the liquid aerosol-forming substrate. The second power may be sufficient to raise the temperature of the heating elements to a temperature sufficient to release volatile compounds from the liquid aerosol-forming substrate.

The thermal atomiser may comprise a resistive heating coil. A thermal atomiser may comprise a plurality of resistive heating coils.

The thermal atomiser may comprise a resistive heating mesh. The thermal atomiser may comprise a plurality of resistive heating meshes.

The resistive heating mesh may comprise a plurality of electrically conductive filaments. The electrically conductive filaments may be substantially flat. As used herein, "substantially flat" means formed in a single plane and not wrapped around or otherwise conformed to fit a curved or other non-planar shape. A flat heating mesh can be easily handled during manufacture and provides for a robust construction.

The electrically conductive filaments may define interstices between the filaments and the interstices may have a width of between about 10 micrometres and about 100 micrometres. Preferably the filaments give rise to capillary action in the interstices, so that in use, liquid aerosol-forming substrate is drawn into the interstices, increasing the contact area between the heater assembly and the liquid.

The electrically conductive filaments may form a mesh of size between about 160 Mesh US and about 600 Mesh US (+/−10%) (that is, between about 160 and about 600 filaments per inch (+/−10%)). The width of the interstices is preferably between about 75 micrometres and about 25 micrometres. The percentage of open area of the mesh, which is the ratio of the area of the interstices to the total area of the mesh is preferably between about 25 percent and about 56 percent. The mesh may be formed using different types of weave or lattice structures. The electrically conductive filaments may be an array of filaments arranged parallel to one another.

The electrically conductive filaments may have a diameter of between about 8 micrometres and about 100 micrometres, preferably between about 8 micrometres and about 50 micrometres, and more preferably between about 8 micrometres and about 39 micrometres.

The resistive heating mesh may cover an area of less than or equal to about 25 square millimetres. The resistive heating mesh may be rectangular. The resistive heating mesh may be square. The resistive heating mesh may have dimensions of about 5 millimetres by about 2 millimetres.

The electrically conductive filaments may comprise any suitable electrically conductive material. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The filaments may be coated with one or more insulators. Preferred materials for the electrically conductive filaments are 304, 316, 304L, and 316L stainless steel, and graphite.

The electrical resistance of the resistive heating mesh is preferably between about 0.3 and about 4 Ohms. More preferably, the electrical resistance of the mesh is between about 0.5 and about 3 Ohms, and more preferably about 1 Ohm.

In embodiments in which the thermal atomiser comprises a resistive heating coil, the pitch of the coil is preferably between about 0.5 millimetres and about 1.5 millimetres, and most preferably about 1.5 millimetres. The pitch of the coil means the spacing between adjacent turns of the coil. The coil may comprise fewer than six turns, and preferably has fewer than five turns. The coil may be formed from an electrically resistive wire having a diameter of between about 0.10 millimetres and about 0.15 millimetres, preferably about 0.125 millimetres. The electrically resistive wire is preferably formed of 904 or 301 stainless steel. Examples of other suitable metals include titanium, zirconium, tantalum and metals from the platinum group. Examples of other suitable metal alloys include, Constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. The resistive heating coil may also comprise a metal foil, such as an aluminium foil, which is provided in the form of a ribbon.

In embodiments in which the thermal atomiser comprises a resistive heating coil, the resistive heating coil may be wound around a liquid transport material.

The power supply may comprise any suitable type of power supply. For example, the power supply may comprise a battery. The power supply may comprise a nickel-metal hydride battery, a nickel cadmium battery, or a lithium based battery, for example a lithium-cobalt, a lithium-iron-phosphate or a lithium-polymer battery. The power supply may comprise another form of charge storage device such as a capacitor. The power supply may require recharging. The power supply may have a capacity that allows for the storage of enough energy for use of the aerosol-generating system over multiple user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the atomiser.

The control electronics may comprise a microprocessor, which may be a programmable microprocessor, a microcontroller, or an application specific integrated chip (ASIC) or other electronic circuitry capable of providing control. The control electronics may comprise further electronic components. The control electronics are configured to regulate a supply of power to the heater assembly. Power may be supplied to the heater assembly continuously following activation of the system or may be supplied intermittently, such as on a puff-by-puff basis. The power may be supplied to the heater assembly in the form of pulses of electrical current.

The control electronics may advantageously comprise DC/AC inverter, which may comprise a Class-D or Class-E power amplifier. The DC/AC inverter may enable the control electronics to supply an alternating voltage from the power supply to the conductivity sensor.

The conductivity sensor may be arranged in any suitable position in the aerosol-generating system.

In some embodiments, the conductivity sensor is arranged in the liquid storage portion. In particular, an inductive conductivity sensor may be arranged in the liquid storage portion.

In some embodiments, the system comprises one or more porous carrier materials for holding and optionally transporting the liquid aerosol-forming substrate. Where the system comprises a porous carrier material in which liquid aerosol-forming substrate is contained, one or more of the electrodes of the conductivity sensor may be arranged at or around the porous carrier material. One or more of the electrodes of the conductivity sensor may be arranged in contact with the porous carrier material. One or more of the electrodes of the conductivity sensor may be arranged in contact with an end of the porous carrier material.

In some embodiments, the conductivity sensor is arranged between the liquid storage portion and the atomiser. In these embodiments, the at least two electrodes of the conductivity sensor may be arranged in or around a flow path of the liquid aerosol-forming substrate extending between the liquid storage portion and the atomiser.

In some embodiments, the atomiser may comprise the conductivity sensor. In other words, the at least two electrodes of the conductivity sensor may be comprised in the atomiser. In some preferred embodiments, the atomiser comprises a plurality of elements, such as heating elements, and at least one of the at least two electrodes of the conductivity sensor may comprise an element of the atomiser. In some embodiments, each electrode of the conductivity sensor comprises an element of the atomiser.

In embodiments in which the atomiser comprises the conductivity sensor, the control electronics may be connected to the atomiser and conductivity sensor in any suitable manner. The control electronics may comprise aerosol-generating circuitry and conductivity measurement circuitry. The aerosol-generating circuitry may control the supply of power to elements of the atomiser for atomising the liquid aerosol-forming substrate. The conductivity measurement circuitry may control the supply of power to the electrodes of the conductivity sensor for measuring the electrical conductivity of the liquid aerosol-forming substrate.

In some embodiments, the control electronics comprise separate aerosol-generating circuitry and conductivity measurement circuitry. In these embodiments, each element of the atomiser that is also configured as an electrode of the conductivity sensor may comprise at least one electrical contact electrically connecting the element to the aerosol-generating circuitry, and at least one electrical contact electrically connecting the element to the conductivity measurement circuitry. Preferably, each element of the atomiser that is also configured as an electrode of the conductivity sensor comprises two electrical contacts electrically connecting the element to the aerosol-generating circuitry, and one electrical contact electrically connecting the element to the conductivity measurement circuitry.

In some embodiments, the control electronics comprises shared aerosol-generating circuitry and conductivity measurement circuitry. In these embodiments, each element of the atomiser that is also configured as an electrode of the conductivity sensor may comprise at least one electrical contact electrically connecting the element to the aerosol-generating circuitry and the conductivity measurement circuitry. Preferably, each element of the atomiser that is also configured as an electrode of the conductivity sensor comprises two electrical contacts electrically connecting the element to the aerosol-generating circuitry and the conductivity measurement circuitry.

In some embodiments, the aerosol-generating system comprises a device and cartridge. The cartridge may be removably receivable in the device. Typically the cartridge comprises the liquid storage portion and the device comprises the power supply and the control electronics. In these embodiments, the conductivity sensor may be provided either in the device or in the cartridge. In some embodiments, the atomiser is provided in the device. In some preferred embodiments, the atomiser is provided in the cartridge.

According to the disclosure, there is provided an aerosol-generating system as described above, the aerosol-generating system comprising a device portion and a cartridge portion, and the cartridge portion being removably receivable in the device portion. The device portion comprises the power supply and control electronics and the cartridge portion comprises the liquid storage portion, the atomiser, and the conductivity sensor.

Advantageously, providing an aerosol-generating system with a conductivity sensor, either in the device or in the cartridge, may enable a manufacturer to standardise cartridge manufacture and device manufacture, regardless of the aerosol-forming substrate that is to be held in the liquid storage portion of the cartridge or the device. In other words, providing an aerosol-generating system with a conductivity sensor may enable a manufacturer to produce identical cartridges and identical devices, regardless of the liquid aerosol-forming substrate that is to be held in the liquid storage portion of the cartridge or the device. Such standardisation may reduce the cost and complexity of manufacturing a cartridge and a device.

In some embodiments, the conductivity sensor is provided in the device. Advantageously, providing the conductivity sensor in the device may reduce the number of components in the cartridge, and in particular may reduce the number of relatively expensive electrical components in the cartridge, reducing the cost and complexity of manufacturing the cartridge.

In some embodiments, the conductivity sensor is provided in the cartridge. In some preferred embodiments in which the atomiser is a thermal atomiser comprising a plurality of heating elements and each electrode of the conductivity sensor is formed from a heating element of the atomiser, the conductivity sensor may be provided in the cartridge. In these preferred embodiments, the thermal atomiser is provided in the cartridge. Such a cartridge is typically referred to as a cartomiser. Cartomisers may enable a high level of hygiene to be maintained in an aerosol-generating system, as the components in contact with aerosol-forming substrate may be regularly replaced, and a user is not exposed to components that come into contact with aerosol-forming substrate.

According to this disclosure, there is provided a cartridge for an aerosol-generating system, the cartridge comprising: a liquid storage portion for holding a liquid aerosol-forming substrate; an atomiser in fluid connection with the liquid storage portion; and a conductivity sensor arranged to sense the electrical conductivity of liquid aerosol-forming substrate from the liquid storage portion.

In some particularly preferred embodiments, the conductivity sensor of the cartridge comprises two electrodes, a first electrode and a second electrode, arranged in the liquid storage portion, each electrode forming a coil, wherein the first electrode is arranged to induce a current in the second electrode when an alternating voltage is supplied to the first electrode. In other words, the cartridge may comprise an inductive conductivity sensor, as described above.

The cartridge may have a simple design. The cartridge may have a housing defining the liquid storage portion. The cartridge housing is preferably a rigid housing comprising a material that is impermeable to liquid. As used herein "rigid housing" means a housing that is self-supporting. The device may also have a housing. The device housing is preferably a rigid housing. The cartridge housing and the device housing may be made from the same material. The device may have a cavity for receiving the cartridge.

Where the cartridge comprises the atomiser the device may comprise electrical contacts for electrically connecting the power supply and the control electronics in the device to the atomiser in the cartridge. Where the cartridge comprises the conductivity sensor, the electrical contacts of the device may electrically connect the control electronics and the power supply in the device to the conductivity sensor in the cartridge.

The aerosol-generating system may comprise a mouthpiece on which a user may draw to receive aerosol generated by the aerosol-generating system. In some systems comprising devices and cartridges, the device comprises the mouthpiece. In some systems comprising devices and cartridges, the cartridge comprises the mouthpiece. Advantageously, providing the mouthpiece on a cartridge may help to maintain a high level of hygiene in the system, as the cartridge may be disposable and replaceable more frequently than the device.

It will be appreciated that features described with reference to one embodiment may also be applicable to other embodiments. For example, features described with reference to a cartridge may be equally applicable to an aerosol-generating system, and particularly to an aerosol-generating system including a cartridge.

The invention will be further described, by way of example only, with reference to the accompanying drawings, in which:

FIG. 1*a* shows a schematic illustration of an aerosol-generating system comprising an aerosol-generating device and a cartridge being inserted into the aerosol-generating device;

FIG. 1*b* shows a schematic illustration of the aerosol-generating system of FIG. 1*a*, in which the cartridge is received in the aerosol-generating device;

Figure 4:
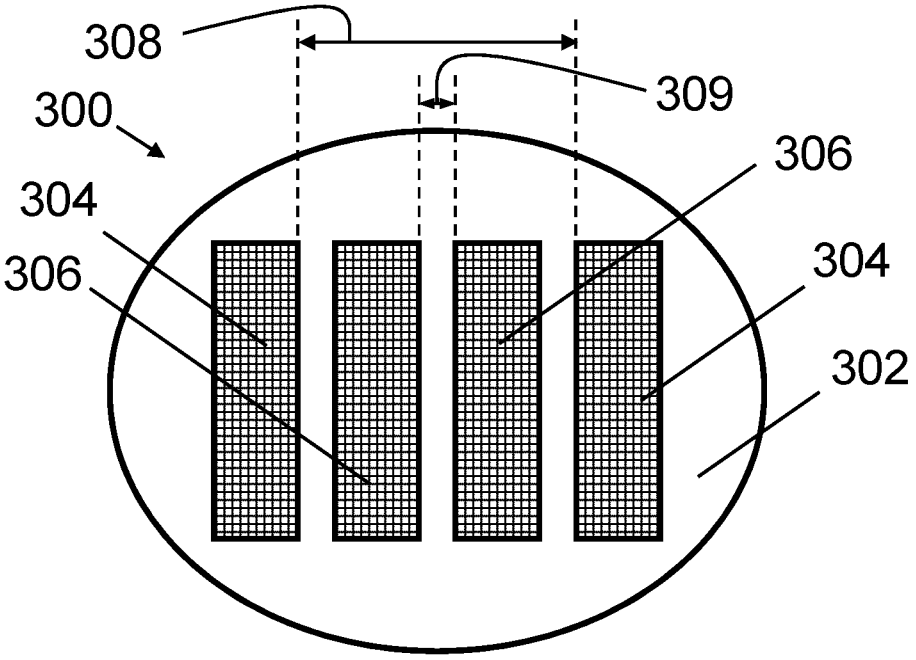
FIG. 4 shows a schematic illustration of an end of a liquid transfer element of an aerosol-generating system, the end of the liquid transfer element having an atomiser and conductivity sensor according to another embodiment of the present invention.
Figure 6A:
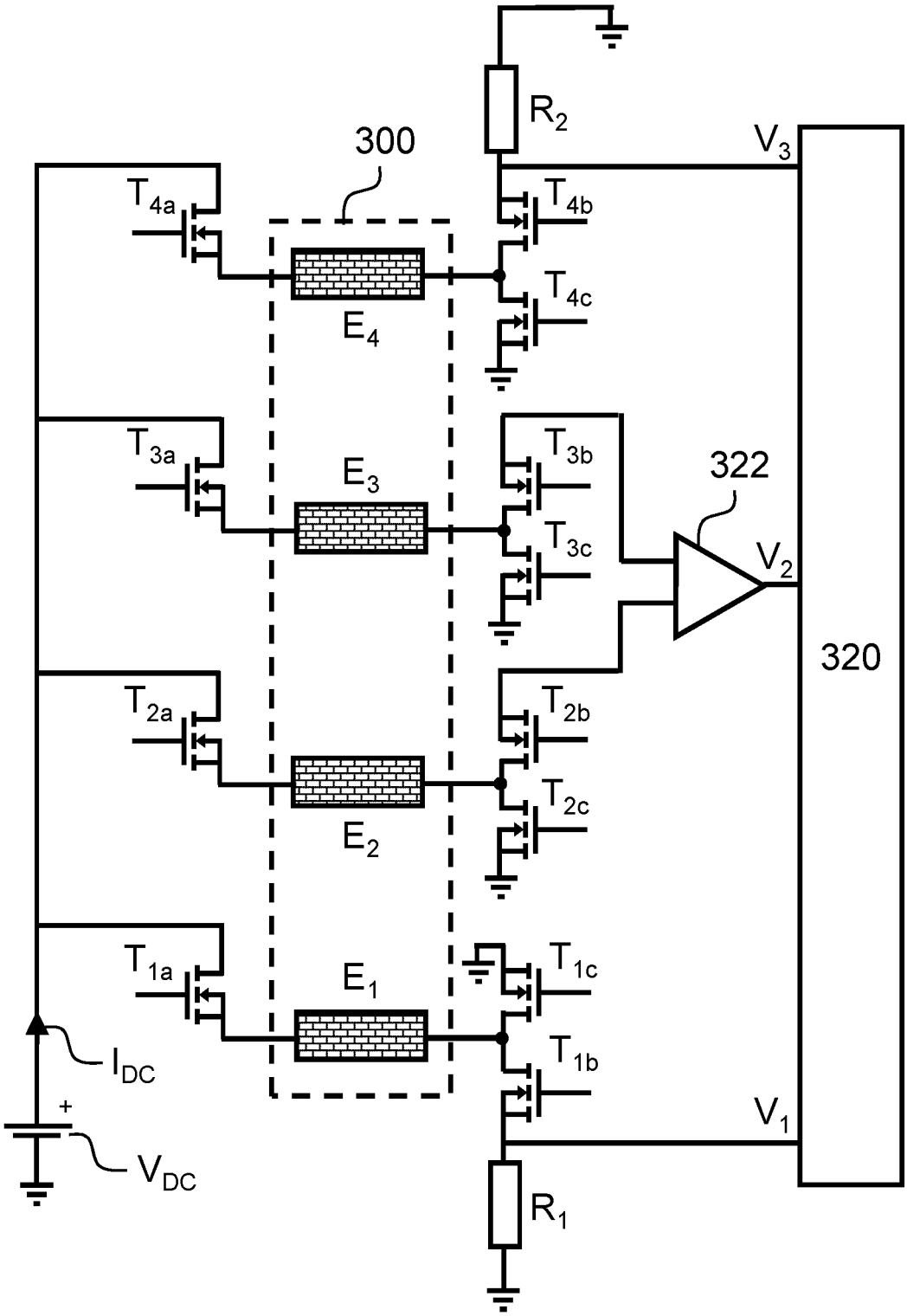
Figure 6B:
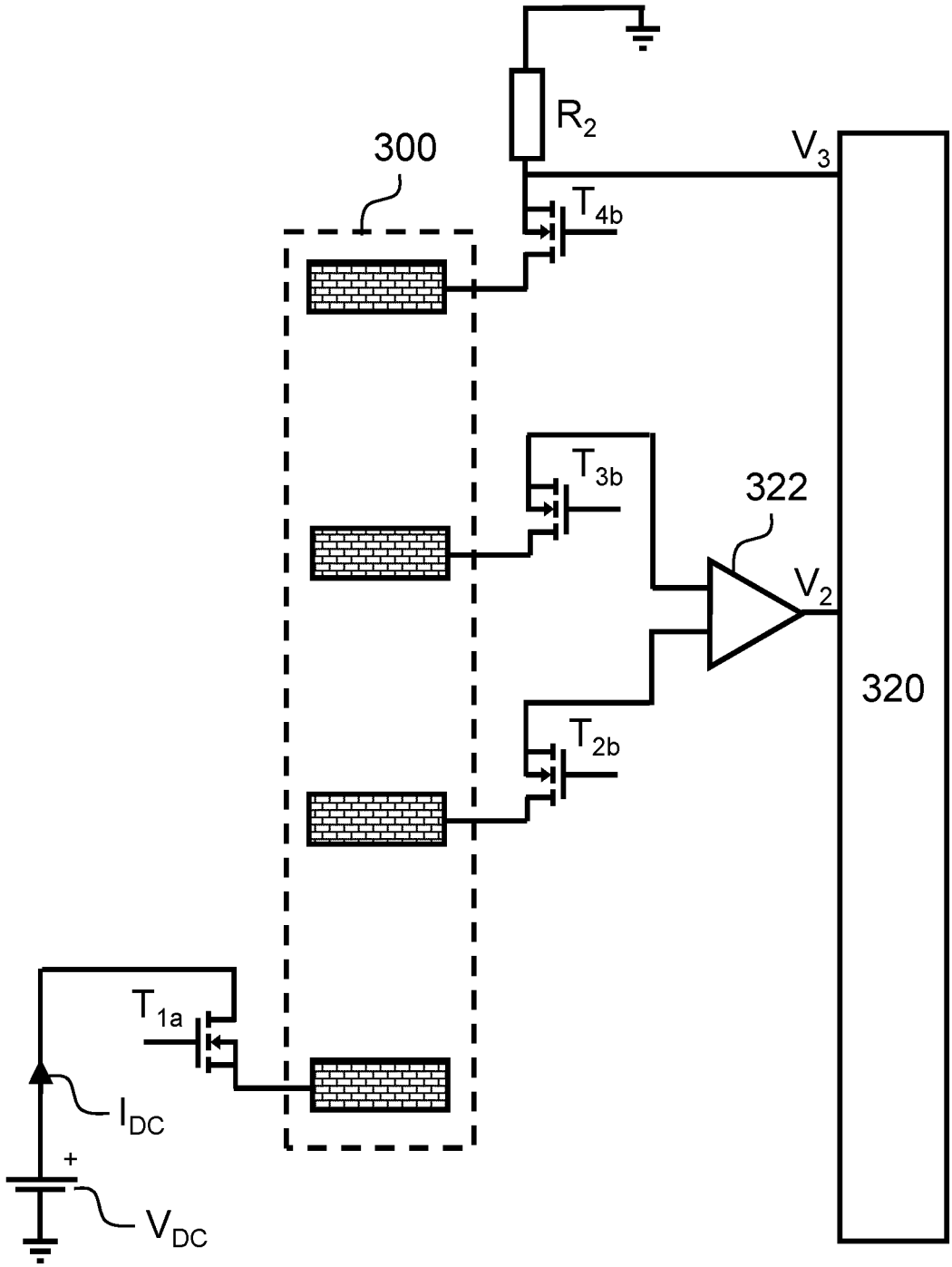
Figure 6C:
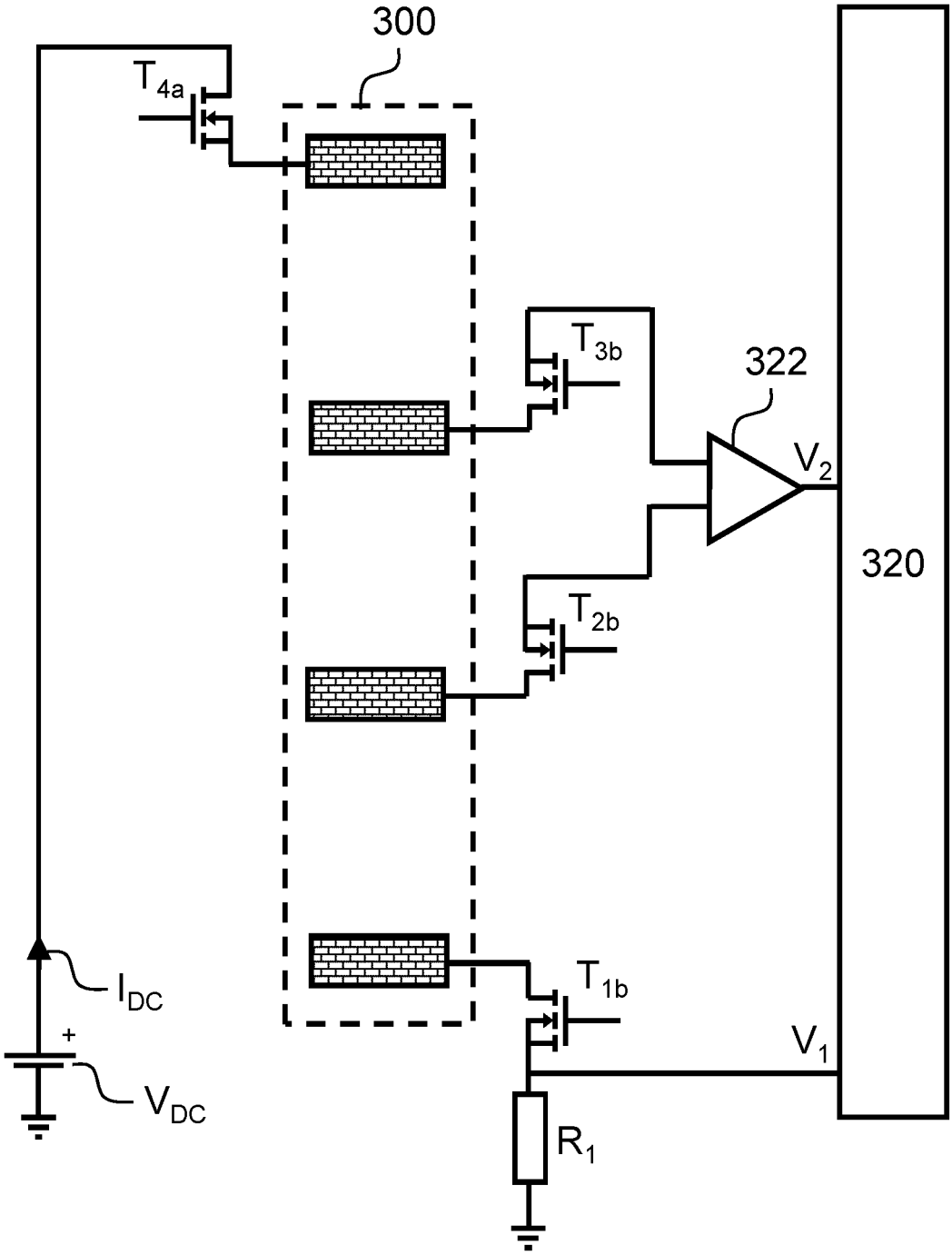
Figure 6D:
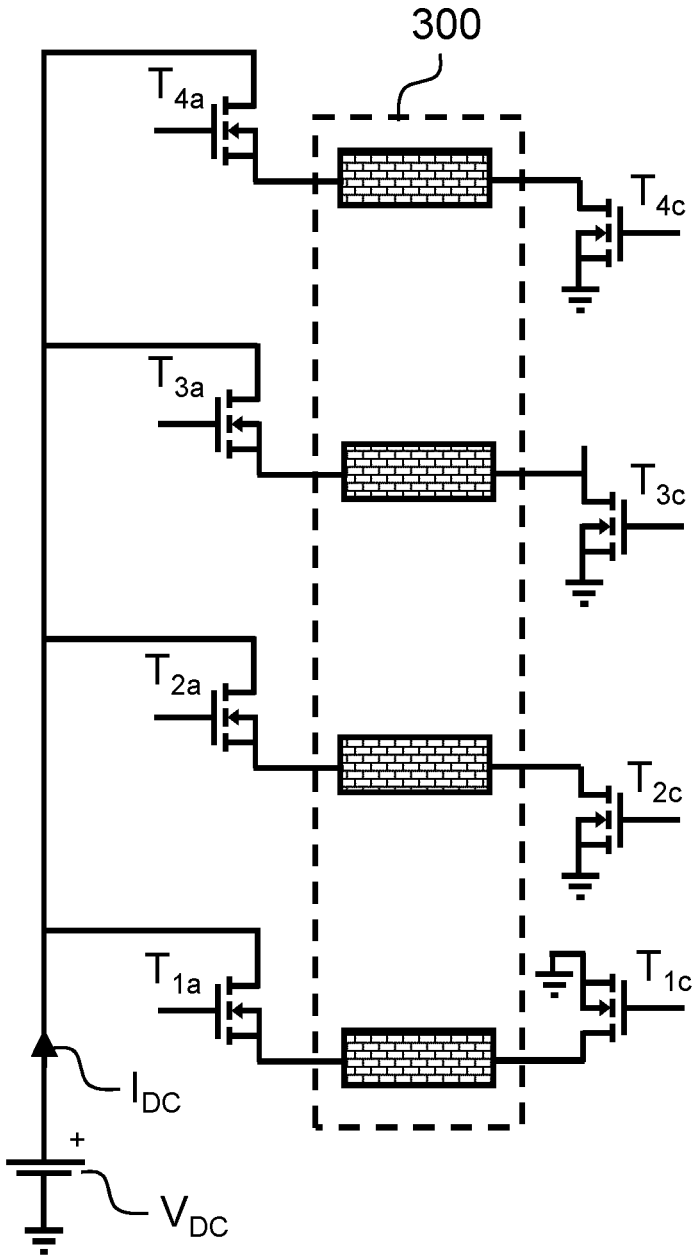
Figure 7:
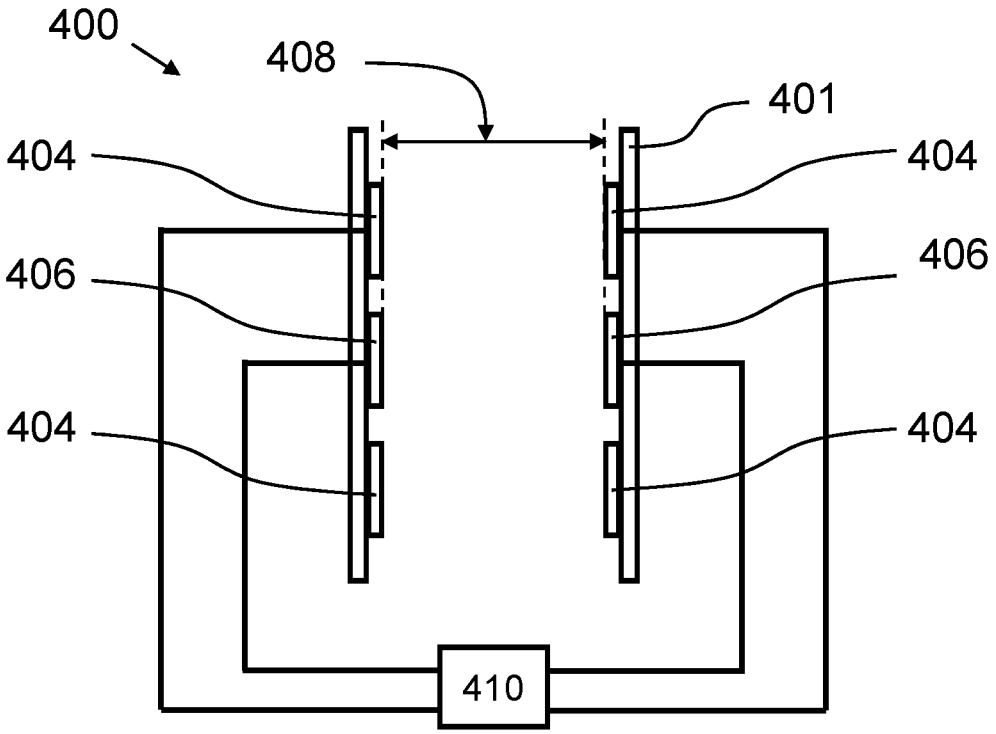
Figure 8:
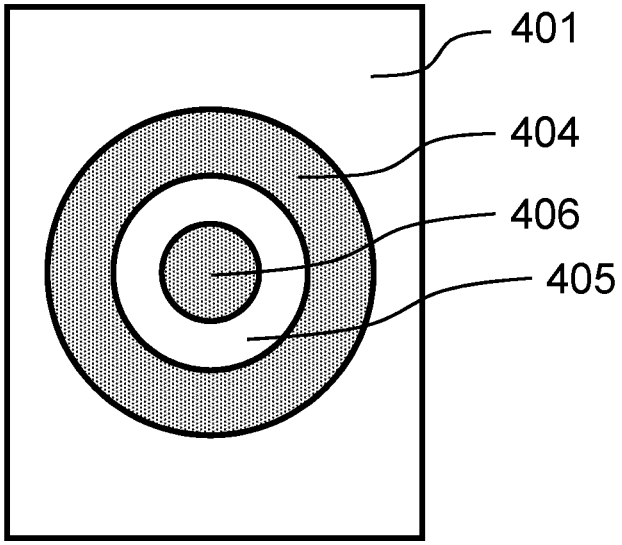
Figure 9:
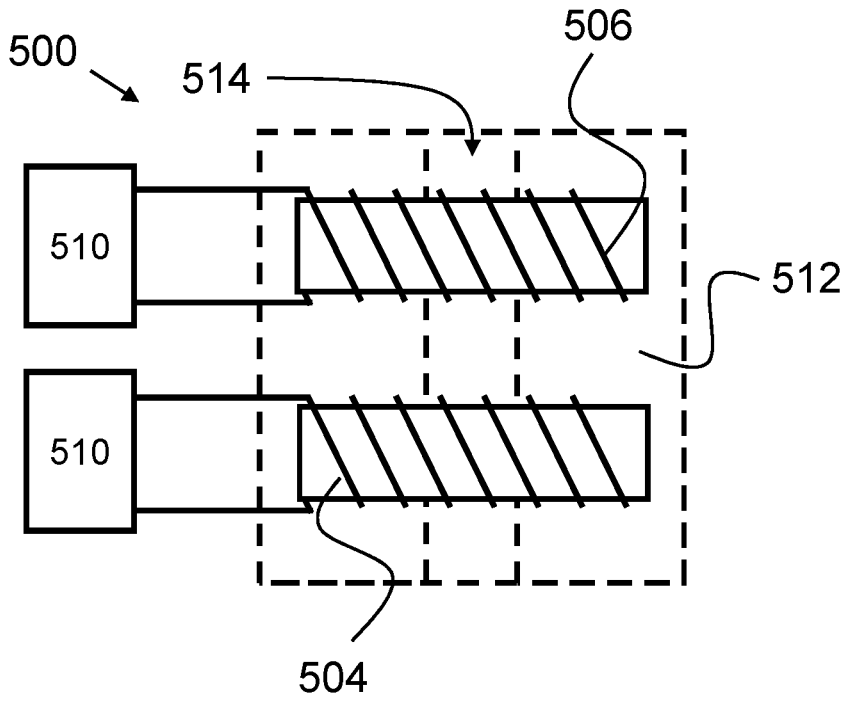
Figure 10:
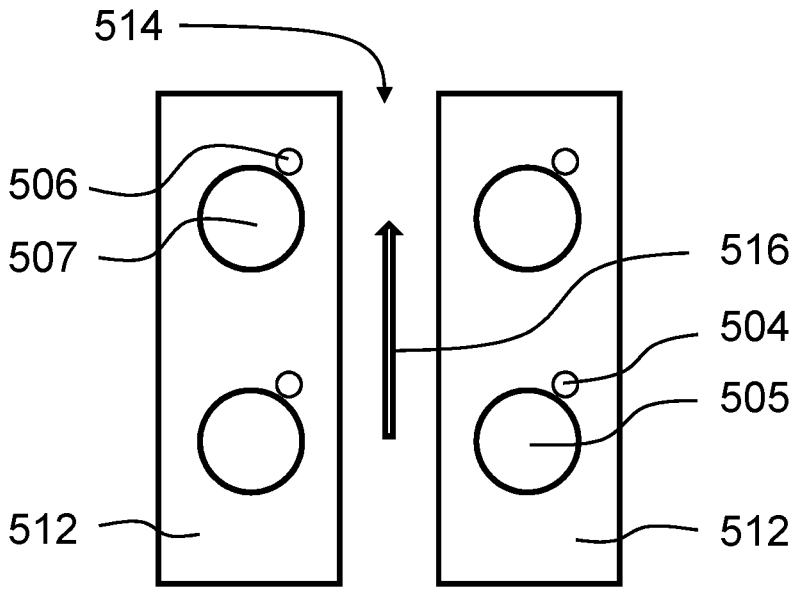

FIGS. 6*a*. 6*b*, 6*c* and 6*d* shows schematic illustrations of elements of an embodiment of the control electronics suitable for use with the atomiser and conductivity sensor of FIG. 4;

FIG. 7 shows a schematic illustration of a four-point conductivity sensor according to another embodiment of the present invention;

FIG. 8 shows a schematic illustration of a first side of the four-point conductivity sensor of FIG. 7;

FIG. 9 shows a schematic illustration of an inductive conductivity sensor according to another embodiment of the present invention; and FIG. 10 shows a schematic illustration of a cross-section through the length of the inductive conductivity sensor of FIG. 9.

Figure 1A:
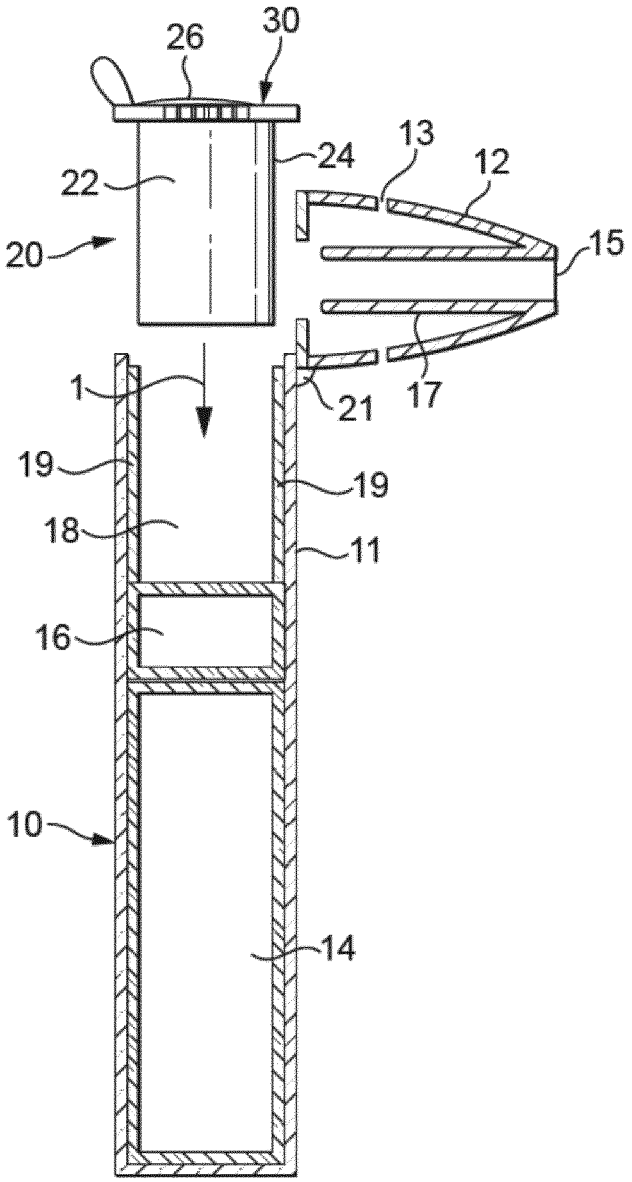
Figure 1B:
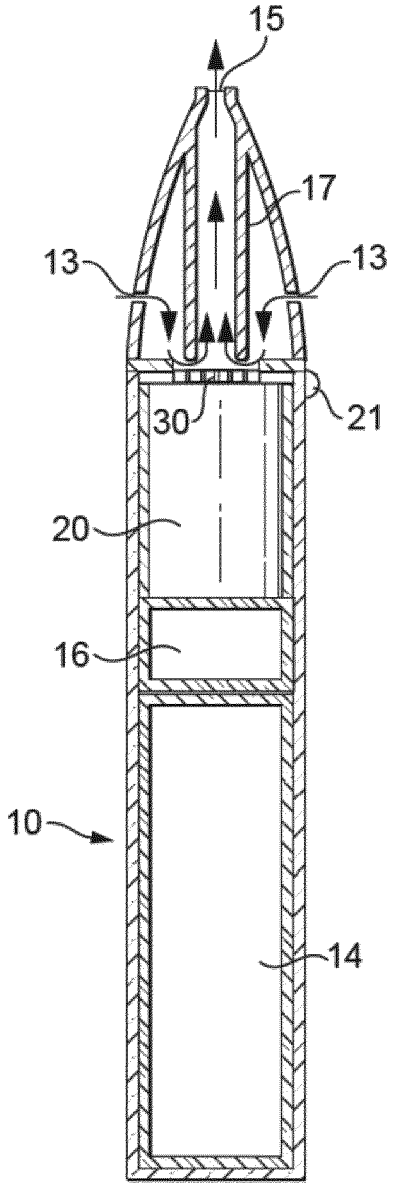

FIGS. 1*a* and 1*b* are schematic illustrations of an exemplary aerosol-generating system, including a cartridge, in which a conductivity sensor may be provided according to embodiments of the present invention. FIGS. 1*a* and 1*b* are FIGS. 1*a* and 1*d* respectively from international patent application publication number WO 2015/117702 A1.

FIG. 1*a* is a schematic view of an aerosol-generating device 10 and a separate cartridge 20, which together form the aerosol-generating system.

The cartridge 20 contains an aerosol-forming substrate and is configured to be received in a cavity 18 within the device. Cartridge 20 should be replaceable by a user when the aerosol-forming substrate provided in the cartridge is depleted. FIG. 1*a* shows the cartridge 20 just prior to insertion into the device, with the arrow 1 in FIG. 1*a* indicating the direction of insertion of the cartridge.

The cartridge 20 comprises a generally circular cylindrical housing 24 that has a size and shape selected to be received into the cavity 18. The housing contains a capillary material (not shown) that is soaked in a liquid aerosol-forming substrate. In this example the aerosol-forming substrate comprises 39% by weight glycerine, 39% by weight propylene glycol, 20% by weight water and flavourings, and 2% by weight nicotine. A capillary material is a material that actively conveys liquid from one end to another, and may be made from any suitable material. In this example the capillary material is formed from polyester.

The housing has an open end to which a heater assembly 30 is fixed. The heater assembly 30 comprises a substrate having an aperture formed in it, a pair of electrical contacts fixed to the substrate and separated from each other by a gap, and a plurality of electrically conductive heater filaments spanning the aperture and fixed to the electrical contacts on opposite sides of the aperture.

The heater assembly 30 is covered by a removable cover 26. The cover comprises a liquid impermeable plastic sheet that is glued to the heater assembly but which can be easily peeled off. A tab is provided on the side of the cover to allow a user to grasp the cover when peeling it off. It will now be apparent to one of ordinary skill in the art that although gluing is described as the method to a secure the impermeable plastic sheet to the heater assembly, other methods familiar to those in the art may also be used including heat sealing or ultrasonic welding, so long as the cover may easily be removed by a consumer.

The aerosol-generating device 10 is portable and has a size comparable to a conventional cigar or cigarette. The device 10 comprises a main body 11 and a mouthpiece portion 12. The main body 11 contains a battery 14, such as a lithium iron phosphate battery, control electronics 16 and a cavity 18. The mouthpiece portion 12 is connected to the main body 11 by a hinged connection 21 and can move between an open position as shown in FIG. 1 and a closed position as shown in FIG. 1*b*. The mouthpiece portion 12 is placed in the open position to allow for insertion and removal of cartridges 20 and is placed in the closed position when the system is to be used to generate aerosol, as will be described. The mouthpiece portion comprises a plurality of air inlets 13 and an outlet 15. In use, a user sucks or puffs on the outlet to draw air from the air inlets 13, through the mouthpiece portion to the outlet 15, and thereafter into the mouth or lungs of the user. Internal baffles 17 are provided to force the air flowing through the mouthpiece portion 12 past the cartridge 20, as will be described.

The cavity 18 has a circular cross-section and is sized to receive the housing 24 of the cartridge 20. Electrical connectors 19 are provided at the sides of the cavity 18 to provide an electrical connection between the control electronics 16 and battery 14 and corresponding electrical contacts on the cartridge 20.

The cartridge 20 is inserted into the cavity 18, and a cover 26 is removed from the cartridge. In this position, the electrical connectors rest against the electrical contacts on the cartridge, as will be described. The mouthpiece portion 12 is then moved to a closed position.

FIG. 1*b* shows the system with the mouthpiece portion 12 in the closed position. The mouthpiece portion 12 is retained in the closed position by a clasp mechanism (not shown).

The mouthpiece portion 12 in a closed position retains the cartridge in electrical contact with the electrical connectors 19 so that a good electrical connection is maintained in use, regardless of the orientation of the system. The mouthpiece portion 12 may include an annular elastomeric element that engages a surface of the cartridge and is compressed between a rigid mouthpiece housing element and the cartridge when the mouthpiece portion 12 is in the closed position. This ensures that a good electrical connection is maintained despite manufacturing tolerances. Of course other mechanisms for maintaining a good electrical connection between the cartridge and the device may be employed.

Figure 2:
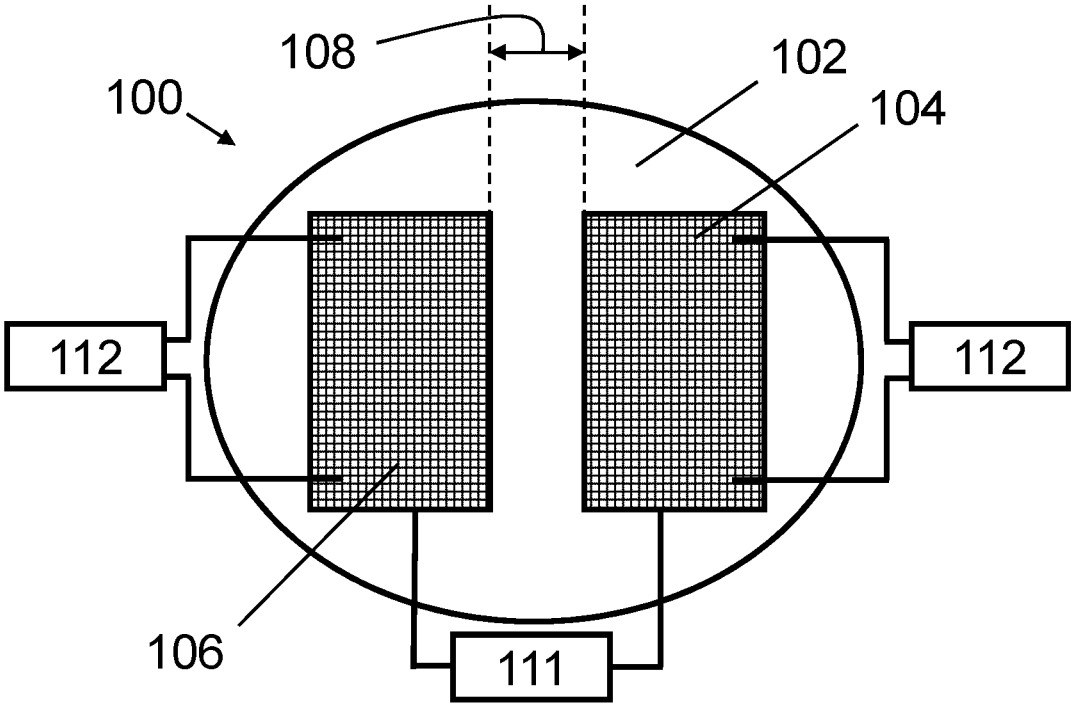
FIG. 2 shows a schematic illustration of an end of a liquid transfer element of an aerosol-generating system, the end of the liquid transfer element having an atomiser and conductivity sensor according to an embodiment of the present invention.

FIG. 2 is a schematic illustration of an exemplary atomiser and conductivity sensor 100 for an aerosol-generating system, such as the aerosol-generating system of FIGS. 1*a* and 1*b*. The atomiser and conductivity sensor 200 is configured a two-point conductivity sensor.

FIG. 2 shows a plan view of a combined atomiser and conductivity sensor 100 of a cartridge received in an aerosol-generating device, and in electrical connection with control electronics 110 of the device. The cartridge comprises a liquid storage portion comprising a generally cylindrical body of capillary material 102 in which a liquid aerosol-forming substrate is held. The atomiser and conductivity sensor 100 shown in FIG. 2 is arranged above and in contact with an end of the generally cylindrical body of capillary material 102. The capillary material 102 is configured such that liquid aerosol-forming substrate held in the capillary material is drawn by capillary action to the end of the capillary body in contact with the atomiser and conductivity sensor 100.

The atomiser and conductivity sensor 100 comprises two electrodes, a first electrode 104 and a second electrode 106. Each of the first electrode 104 and the second electrode 106 comprises a resistive heating mesh, which comprises a plurality of electrically conductive heater filaments. The first electrode 104 is spaced from the second electrode 106, such that there is a cavity 108 between the first electrode 104 and the second electrode 106. The cavity 108 between the first electrode 104 and the second electrode 106 is sufficiently wide to electrically insulate the first electrode 104 from the second electrode 106 on the capillary material 102 when no liquid aerosol-forming substrate is present in the capillary material 102.

The first and second electrodes 104, 106 are configured such that liquid aerosol-forming substrate at the end of the capillary body contacts the first and second electrodes 104, 106.

In the embodiment shown in FIG. 2, the first and second electrodes 104, 106 are electrically connected to control electronics of an aerosol-generating device (not shown), such as the aerosol-generating device of FIGS. 1*a* and 1*b*. The control electronics of the aerosol-generating device are configured to control a supply of power from a power supply of the device to the first electrode 104 and the second electrode 106.

In this embodiment, the control electronics of the aerosol-generating device comprise separate conductivity measurement circuitry 111 and aerosol-generating circuitry 112. Each of the conductivity measurement circuitry 111 and the aerosol-generating circuitry 112 comprises electrical contacts in the form of resilient pin contacts for providing a reliable electrical connection between the control electronics of the aerosol-generating device and the first and second electrodes 104, 106 when the cartridge is received in the device.

Each of the first and second electrodes 104, 106 is electrically connected to the conductivity measurement circuitry 111 by a single electrical contact. Accordingly the conductivity measurement circuitry comprises two electrical contacts, one for each electrode 104, 106.

The conductivity measurement circuitry 111 is configured to supply an alternating voltage between the two electrical contacts of the conductivity measurement circuitry, which in turn establishes an alternating voltage between the first and second electrodes 104, 106. The alternating voltage between the first and second electrodes 104, 106 drives an alternating current across the cavity 108 between the first and second electrodes 104, 106, through the liquid aerosol-forming substrate disposed in the cavity 108. The conductivity measurement circuitry 111 is further configured to measure the current between the first and second electrodes 104, 106, and determine the electrical conductivity of the liquid aerosol-forming substrate disposed in the cavity 108 based on the measured current. The electrical conductivity of the liquid aerosol-forming substrate provides an indication of the nicotine concentration in the liquid aerosol-forming substrate.

Each of the first and second electrodes 104, 106 is also separately electrically connected to the aerosol-generating circuitry 112 by two electrical contacts. Each of the first and second electrodes 104, 106 is electrically connected to a first electrical contact at a first end of the electrode, and is electrically connected to a second electrical contact at a second end of the electrode, opposite the first end. The aerosol-generating circuitry 112 is configured to supply a voltage between the first and second electrical contact for each of the first and second electrodes 104, 106. The voltage across the first electrode 104, between the first and second electrical contacts, drives a current through the first electrode 104 between the first and second electrical contacts. The voltage across the second electrode 204, between the first and second electrical contacts, drives a current through the second electrode 204 drives a current through the second electrode 106 between the first and second electrical contacts. The current through each electrode is suitable for heating the electrode. The aerosol-generating circuitry 112 is configured to supply a direct current between the two electrical contacts of each electrode 104, 106, in pulses. The aerosol-generating circuitry 112 is configured to vary the duty cycle of the pluses of direct current to vary the temperature of the electrodes 104, 106.

The conductivity measurement circuitry 111 is configured to supply a first power to the first and second electrodes 104, 106, and the aerosol-generating circuitry 112 is configured to supply a second power to the first and second electrodes 104, 106. Preferably, the first power is not sufficient to heat the heater filaments of the electrodes 104, 106 and vaporise liquid aerosol-forming substrate in contact with the heater filaments. The second power is sufficient to heat the heater filaments of the first and second electrodes 104, 106 to vaporise liquid aerosol-forming substrate in contact with the heater filaments. The aerosol-generating circuitry 112 is configured to vary the second power based on the electrical conductivity of the liquid aerosol-forming substrate determined by the conductivity measurement circuitry 111, which provides an indication of the nicotine concentration in the liquid aerosol-forming substrate.

In this embodiment, the conductivity measurement circuitry 111 is configured to supply the first power to the first and second electrodes 104, 106 and measure the electrical conductivity of the liquid aerosol-forming substrate disposed in the cavity 108 before the aerosol-generating circuitry 112 supplies the second power to the first and second electrodes 104, 106 to heat the liquid aerosol-forming substrate. This enables the aerosol-generating circuitry 112 to adjust the second power in response to the determined nicotine concentration of the liquid aerosol-forming substrate before each aerosol-generation cycle, such as each time a user draws on the aerosol-generating system to receive aerosol from the system.

Figure 3:
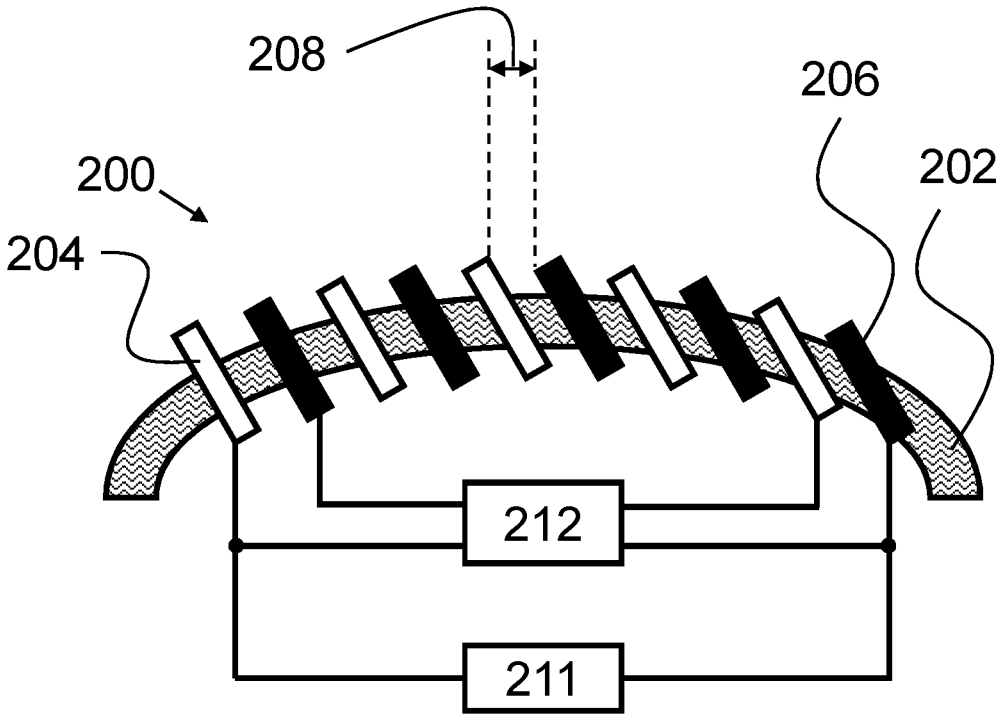
FIG. 3 shows a schematic illustration of an atomiser and conductivity sensor according to another embodiment of the present invention.

FIG. 3 is a schematic illustration of another exemplary atomiser and conductivity sensor 200 for an aerosol-generating system. The atomiser and conductivity sensor 200 is configured as a two-point conductivity sensor.

In this embodiment, a cartridge (not shown) comprises a liquid transport element 202 in the form of a wick having at least one end in contact with liquid aerosol-forming substrate in a liquid storage portion of the cartridge. The combined atomiser and conductivity sensor 200 of this embodiment comprises two electrodes 204, 206, in the form of coils, arranged at a portion of the liquid transport material 202 outside of the liquid storage portion. The liquid transport material 202 is arranged to draw liquid aerosol-forming substrate out of the liquid storage portion and to the first and second coil electrodes 204, 206 of the combined atomiser and conductivity sensor 200. Each coil electrode 204, 206 comprises a resistive heating wires wound concentrically in a spiral around a portion of the wick outside of the liquid storage portion. The two coil electrodes 204, 206 are substantially identical, being wound together around the wick in the same direction and comprising the same number of turns. The second coil 206 is offset from the first coil 204 along the wick such that a cavity 208 is provided between corresponding turns of the first and second coils 204, 206. The cavity between the corresponding turns of the first and second coils 204, 206 is such that liquid aerosol-forming substrate in the wick may be drawn into the cavity 208 and disposed between the coil electrodes 204, 206.

The first and second coil electrodes 204, 206 are configured such that liquid aerosol-forming substrate in the cavity 208 between the first and second coil electrodes 204, 206 is in contact with the first and second coil electrodes 204, 206.

In the embodiment shown in FIG. 3, the first and second coil electrodes 204, 206 are electrically connected to control electronics of an aerosol-generating device (not shown), such as the aerosol-generating device of FIGS. 1*a* and 1*b*. The control electronics of the aerosol-generating device are configured to control a supply of power from a power supply of the device to the first electrode 204 and the second electrode 206.

In this embodiment, the control electronics of the aerosol-generating device comprises shared conductivity measurement circuitry 211 and aerosol-generating circuitry 212. The conductivity measurement circuitry 211 and the aerosol-generating circuitry 212 comprise shared electrical contacts.

Each of the first and second coil electrodes 204, 206 is electrically connected to the aerosol-generating circuitry 212 by two electrical contacts, one electrical contact at each end of the coil electrode. The aerosol-generating circuitry 212 is configured to supply a voltage between the contacts at opposite ends of each coil, such that a voltage is established across each of the first and second electrodes 204, 206. The voltage across the first electrode 204 drives a current through the first electrode 204 for heating the electrode. The voltage across the second electrode 206 drives a current through the second electrode 206 for heating the electrode. The aerosol-generating circuitry 212 is configured to supply a direct current through each of the first and second electrodes 204, 206 in pulses. The aerosol-generating circuitry 212 is configured to vary the duty cycle of the pluses of direct current to vary the temperature of the first and second electrodes 204, 206.

In this embodiment, the conductivity measurement circuitry 211 shares electrical contacts with the aerosol-generating circuitry 212. Each of the first and second coil electrodes 204, 206 is electrically connected to the conductivity measurement circuitry 211 by one electrical contact. The conductivity measurement circuitry 211 is electrically connected to the first coil electrode 204 by the electrical contact at a first end of the first coil electrode 204, and is electrically connected to the second coil electrode 206 by the electrical contact at a second end of the second coil electrode 206, which is the end of the second coil electrode 206 that is farthest from the first end of the first coil electrode 204. Accordingly, the conductivity measurement circuitry 211 comprises two electrical contacts, one for each coil electrode 204, 206.

The conductivity measurement circuitry 211 is configured to supply an alternating voltage between the two electrical contacts of the conductivity measurement circuitry 211, which in turn establishes an alternating voltage between the first and second coil electrodes 204, 206. The alternating voltage between the first and second coil electrodes 204, 206 drives an alternating current across the cavity 208, between the first and second electrodes 204, 206, through liquid aerosol-forming substrate disposed in the cavity 208. The conductivity measurement circuitry 211 is further configured to measure the current between the first and second coil electrodes 204, 206, and determine the electrical conductivity of the liquid aerosol-forming substrate disposed in the cavity 208 based on the measured current. The electrical conductivity of the liquid aerosol-forming substrate provides an indication of the nicotine concentration in the liquid aerosol-forming substrate.

The conductivity measurement circuitry 211 is configured to supply a first power to the first and second coil electrodes 204, 206, and the aerosol-generating circuitry 212 is configured to supply a second power to the first and second electrodes 204, 206. Preferably, the first power is not sufficient to heat the coil electrodes 204, 206 and vaporise liquid aerosol-forming substrate in contact with the coil electrodes.

The second power is sufficient to heat the first and second coil electrodes 204, 206 to vaporise liquid aerosol-forming substrate in contact with the coil electrodes. The aerosol-generating circuitry 212 is configured to vary the second power based on the electrical conductivity of the liquid aerosol-forming substrate determined by the conductivity measurement circuitry 211, which provides an indication of the nicotine concentration in the liquid aerosol-forming substrate.

It will be appreciated that in other embodiments the first and second coil electrodes 204, 206 may be separately electrically connected to the conductivity measurement circuitry and aerosol-generating circuitry of an aerosol-generating device in a similar manner to the first and second electrodes 104, 106 of the atomiser and conductivity sensor described above in relation to FIG. 2.

Figure 5:
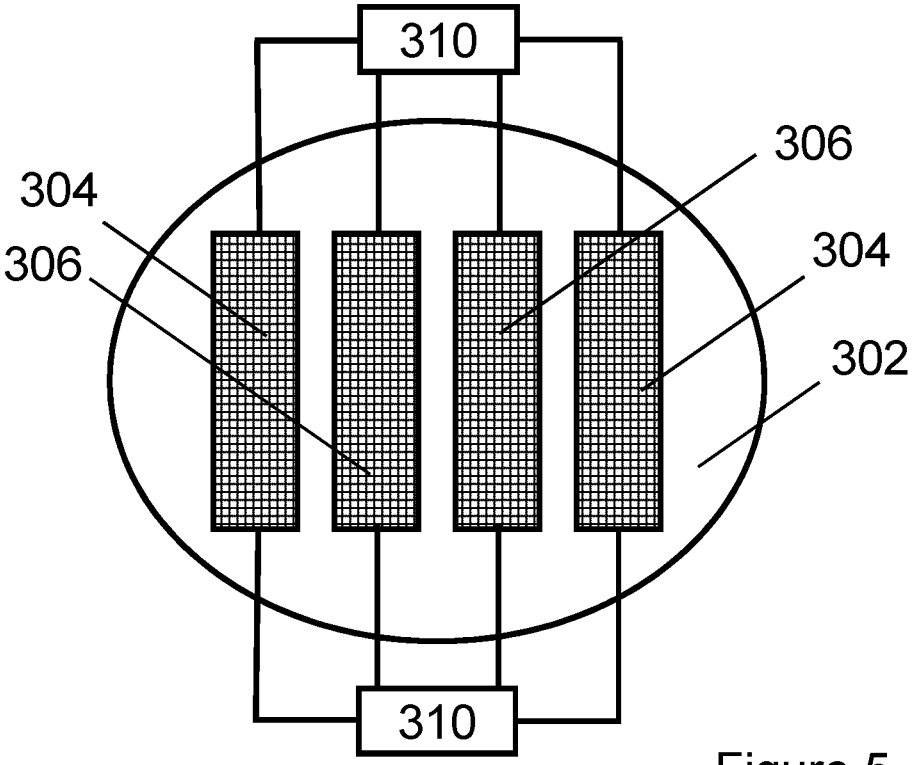
FIG. 5 shows a schematic illustration of the end of the liquid transfer element of FIG. 4 including an electrical connection between the atomiser and conductivity sensor and control electronics of an aerosol-generating device.

FIGS. 4 and 5 are schematic illustrations of another exemplary atomiser and conductivity sensor 300 for an aerosol-generating system, such as the aerosol-generating system of FIGS. 1*a* and 1*b*. The atomiser and conductivity sensor 300 is configured as a four-point conductivity sensor.

FIG. 4 shows a plan view of a combined atomiser and conductivity sensor 300 of a cartridge and FIG. 5 shows a plan view of the cartridge received in an aerosol-generating device, and in electrical connection with control electronics 310 of the device.

The cartridge comprises a liquid storage portion comprising a generally cylindrical body of capillary material 302 in which a liquid aerosol-forming substrate is held. The atomiser and conductivity sensor 300 shown in FIGS. 4 and 5 is arranged above and in contact with an end of the generally cylindrical body of capillary material 302. The capillary material 302 is configured such that liquid aerosol-forming substrate held in the capillary material is drawn by capillary action to the end of the capillary body in contact with the atomiser and conductivity sensor 300.

The atomiser and conductivity sensor 300 comprises four electrodes, a pair of outer electrodes 304 and a pair of inner electrodes 306. Each of the electrodes 304, 306 comprises a resistive heating mesh, which comprises a plurality of electrically conductive heater filaments.

The pair of outer electrodes 304 are spaced apart such that there is an outer cavity 308 between the outer electrodes 304. The outer cavity 308 between the outer electrodes 304 is sufficiently wide to electrically insulate the outer electrodes 304 from each other on the capillary material 302 when no liquid aerosol-forming substrate is present in the capillary material 302.

The pair of inner electrodes 306 are arranged between the pair of outer electrodes 304, in the outer cavity 308. The pair of inner electrodes 306 are sufficiently spaced from the pair of outer electrodes 304 to electrically insulate the inner electrodes 306 from the outer electrodes 304 on the capillary material 302 when no liquid aerosol-forming substrate is present in the capillary material 302. The pair of inner electrodes 306 are spaced apart such that there is an inner cavity 309 between the inner electrodes 306. The inner cavity 309 between the inner electrodes 306 is sufficiently wide to electrically insulate the inner electrodes 306 from each other on the capillary material 302 when no liquid aerosol-forming substrate is present in the capillary material 302.

Liquid aerosol-forming substrate at the end of the capillary body in contact with the atomiser and conductivity sensor 300 contacts the inner and outer electrodes 204, 206.

The provision of four electrodes in such an arrangement enables the combined atomiser and conductivity sensor 300 of this embodiment to be used as a four-point conductivity sensor, as described in more detail below.

In FIG. 5, the inner and outer electrodes 304, 306 are shown in electrical connection with control electronics 310 of an aerosol-generating device (not shown), such as the aerosol-generating device of FIGS. 1*a* and 1*b*. The control electronics 310 of the aerosol-generating device are configured to control a supply of power from a power supply of the device to the outer electrodes 304 and the inner electrodes 306.

In this embodiment, the control electronics 310 of the aerosol-generating device comprises shared conductivity measurement circuitry and aerosol-generating circuitry, as described in more detail below with reference to FIG. 6. In this embodiment, the conductivity measurement circuitry and the aerosol-generating circuitry comprise shared electrical contacts in the form of resilient pin contacts for providing a reliable electrical connection between the control electronics 310 of the aerosol-generating device and the inner and outer electrodes 304, 306. It will be appreciated that in other embodiments the aerosol-generating circuitry and the conductivity measurement circuitry may comprise separate electrical contacts.

In this embodiment, each of the inner and outer electrodes 304, 306 is electrically connected to the control circuitry 310 by two electrical contacts. Each of the inner and outer electrodes 304, 306 is electrically connected to a first electrical contact at a first end of the electrode, and is electrically connected to a second electrical contact at a second end of the electrode, opposite the first end.

FIGS. 6*a-d* schematically show some components of an exemplary embodiment of control electronics 310 of an aerosol-generating device in connection with the combined atomiser and conductivity sensor of FIGS. 4 and 5.

The control electronics are configured to operate in two different modes, a conductivity measurement mode and a heating mode. In the conductivity measurement mode, an alternating voltage is supplied between the two outer electrodes 304 and the voltage is measured across the two inner electrodes 306. In the heating mode, a pulsed direct current is supplied across each of the inner and outer electrodes 304, 306, individually, to heat the heater filaments of the electrodes and vaporise liquid aerosol-forming substrate in contact with the heater filaments.

In this embodiment, the control electronics 310 generally comprises a DC power source Vim, a microcontroller 320 and a plurality of transistor switches. The transistor switches are Field Effect Transistors (FETs) that are controlled by the control electronics to supply power to the combined atomiser and conductivity sensor according to the conductivity measurement mode and the heating mode.

In FIGS. 6*a-d*, a first one of the outer electrodes is shown as $E_1$, a second one of the outer electrodes is shown as $E_4$, a first one of the inner electrodes is shown as $E_2$ and a second one of the inner electrodes is shown as $E_3$. As shown in FIG. 6*a*, each electrode $E_1$-$E_4$ is connected to the control electronics by two electrical contacts spaced apart at opposite ends of the electrode. Each electrode $E_1$-$E_4$ is connected by a first electrical contact to the DC power supply via a first transistor switch $T_{1a}$-$T_{4a}$. Each electrode is further connected by a second electrical contact to a position between a second transistor switch $T_{1b}$-$T_{4b}$, and a third transistor stich $T_{1c}$-$T_{4c}$. The first transistor switches $T_{1a}$-$T_{4a}$ enable the control electronics to individually isolate each of the electrodes from the power supply when the transistors is transistors are off. The function of the second and third transistor switches $T_{1b}$-$T_{4b}$, $T_{1c}$-$T_{4c}$ will be discussed in further detail below.

In the conductivity measurement mode, the control electronics supply a high frequency alternating switching voltage to the gate of each of the first and second transistors of the outer electrodes, $T_{1a}$, $T_{1b}$, $T_{4a}$, $T_{4b}$, so that during one half period the transistors $T_{1a}$ and $T_{4b}$ are conducting and transistors $T_{1b}$ and $T_{4a}$ are off, and during the other half period transistors $T_{1b}$ and $T_{4a}$ are conducting and transistors $T_{1a}$ and $T_{4b}$ are off.

FIG. 4*b* illustrates the connection of the combined atomiser and conductivity sensor to the power supply in the conductivity measurement mode during the first half period, with transistors $T_{1a}$ and $T_{4b}$ conducting. The arrangement shown in FIG. 4*b* can be considered to comprise first drive circuit that operates to provide a first periodic voltage drop across the outer electrodes $E_1$, $E_4$, with a selected frequency F, and having an amplitude ranging from a first value to a second value lower than the first value.

FIG. 4*c* illustrates the connection of the combined atomiser and conductivity sensor to the power supply in the conductivity measurement mode during the second half period, with transistors $T_{4a}$ and $T_{1c}$ conducting. The arrangement shown in FIG. 4*c* can be considered to provide a second periodic voltage drop across the outer electrodes $E_1$, $E_4$, at the same frequency and amplitude as the first periodic voltage drop, but of opposite polarity and directly out of phase with the first periodic voltage.

The first and second periodic voltage drops are of opposite polarity to one another, where opposite polarity in this context refers to the relative position of the high and low voltage sides, rather than requiring a positive voltage and a negative voltage. Since the first and second periodic voltage drops are applied from opposite ones of the outer electrodes. Since the first and second periodic voltage drops are of opposite polarity and directly out of phase, an AC voltage is effectively supplied across the outer electrodes. The first and second periodic voltage drops may have any suitable waveform. For example, the two waveforms may be square waves that are directly out of phase with one another. Advantageously, the control electronics may be configured to provide a dead time period of a least a few nanoseconds between the end of one voltage drop and the start of the next voltage drop in the opposite direction, in order to avoid burn out of the switches.

In the first half period, the second transistor $T_{4b}$ of the second outer electrode $E_4$ is conducting, and provides a path to electrical ground via a resistor having a known resistance $R_2$. The microprocessor 220 is configured to measure the voltage $V_3$ across the resistor $R_2$, and may determine the current flowing between the first outer electrode $E_1$ and the second outer electrode $E_4$ from the measured voltage $V_3$ and known resistance $R_2$.

In the second half period, the second transistor $T_{1b}$ of the first outer electrode $E_1$ is conducting, and provides a path to electrical ground via a resistor having a known resistance $R_1$. The control electronics are configured to measure the voltage $V_1$ across the resistor $R_1$, and may determine the current flowing between the second outer electrode $E_4$ and the first outer electrode $E_1$ from the measured voltage $V_1$ and known resistance $R_1$.

During the conductivity measurement mode, the control electronics are further configured to supply a voltage to the gate of each of the second transistors, $T_{1b}$, $T_{2b}$, of the two inner electrodes $E_2$, $E_3$, so that the second transistors $T_{1b}$, $T_{2b}$ of the two inner electrodes $E_2$, $E_3$ are conducting. In the conductivity measurement mode, the control electronics do not supply a voltage to the third transistors of any of the inner or outer electrodes, so that all of the third transistors remain off.

Each of the second transistors $T_{2b}$, $T_{3b}$ of the inner electrodes $E_2$, $E_3$, provide a path to an input of a differential amplifier 322, the output of which is supplied to the microprocessor 320 to provide the microprocessor 320 with a measurement of the voltage $V_2$ across the inner electrodes $E_2$, $E_1$.

The microprocessor 320 may be configured in a number of different ways to determine an indication of the concentration of nicotine in the liquid aerosol-forming substrate between the electrodes of the combined atomiser and conductivity sensor using the measured voltages $V_1$, $V_2$ and $V_3$. In this embodiment, the microprocessor 320 is configured to determine the current between the outer electrodes $E_1$, $E_4$ using the measured voltages $V_1$, $V_3$ and to use to determined current and the measured voltage $V_2$ across the inner electrodes $E_2$, $E_3$ to determine the electrical conductivity of the liquid aerosol-forming substrate, and to determine an indication of the concentration of nicotine in the liquid aerosol-forming substrate.

In the heating mode, the control electronics supply a high frequency alternating switching voltage to the gate of each of the first transistors $T_{1a}$, $T_{2a}$, $T_{3a}$, $T_{4a}$ of all of the electrodes, $E_1$, $E_2$, $E_3$, $E_4$, so that all of the first transistors are alternated periodically between conducting and off. The control electronics also supply a voltage to the gate of each of the third transistors $T_{1c}$, $T_{2c}$, $T_{3c}$, $T_{4c}$ of all of the electrodes $E_1$, $E_2$, $E_3$, $E_4$, so that the third transistors are conducting. The third electrodes $T_{1c}$, $T_{2c}$, $T_{3c}$, $T_{4c}$ provide a path to electrical ground.

FIG. 4*d* illustrates the connection of the combined atomiser and conductivity sensor 300 to the power supply in the heating mode, with the transistors $T_{1a}$, $T_{2a}$, $T_{3a}$, $T_{4a}$, $T_{1c}$, $T_{2c}$, $T_{3c}$, and $T_{4c}$ conducting. The arrangement shown in FIG. 4*d* can be considered to comprise third drive circuitry that operates to supply a current across each of the electrodes.

By periodically switching the first transistors between conducting and off, and by maintaining the third transistors as conducting, the control electronics supply a pulsed direct current across each of the electrodes. The control electronics are configured to control the duty cycle of the pulses to control the temperature to which the electrodes are heated. Preferably, the control electronics are configured to control the duty cycle in the heating mode based on the indication of nicotine concentration determined in the conductivity measurement mode.

It will be appreciated that in other embodiments, the control electronics of the aerosol-generating device may not be arranged to directly supply power to the inner electrodes for heating the inner electrodes, but rather the control electronics may be arranged to heat the inner electrodes by induction. In these embodiments, an oscillating voltage is applied to the outer electrode, which induces a current in the inner electrodes. In order for the inner electrodes to be heated to a sufficient temperature, it is preferable that the inner electrodes are susceptor elements formed from a magnetic material, such as AISI 4xx stainless steels. Although the outer electrodes may be formed from a magnetic material, this is not an essential requirement in these embodiments.

FIGS. 7 and 8 show schematic illustrations of another exemplary conductivity sensor 400. In this embodiment, the conductivity sensor 400 is not combined with an atomiser. In this embodiment, the conductivity sensor is configured as a four-point conductivity sensor that is arranged in a liquid storage portion of a cartridge of an aerosol-generating device.

The cartridge comprises a housing 401 defining a substantially cuboidal liquid storage portion. The housing is formed from a rigid, electrically insulating material, such as PEEK. The conductivity sensor 400 comprises four electrodes, two outer electrodes 404 and two inner electrodes 406. A first one of the outer electrodes 404 and a first one of the inner electrodes 406 are arranged on a first inner surface of the cartridge housing 401, and a second one of the outer electrodes 404 and a second one of the inner electrodes 406 are arranged on a second inner surface of the cartridge housing 401, opposite the first surface, such that the first outer and inner electrodes are facing the second outer and inner electrodes across the liquid storage portion.

The outer electrodes 404 comprise identical ring electrodes, defining an outer electrode cavity 407. The inner electrodes 406 comprise identical circular electrodes. As shown in FIG. 8, at the first inner surface of the cartridge housing 401 the first outer electrode 404 and the first inner electrode 406 are arranged concentrically, with the first inner electrode 406 arranged in the outer electrode cavity 405 of the first outer electrode 404. Similarly, at the second inner surface of the cartridge housing 401, the first outer electrode 404 and the first inner electrode 406 are arranged concentrically, with the second inner electrode 406 arranged in the outer electrode cavity 405 of the second outer electrode 404. The outer diameters of the inner electrodes 406 are smaller than the inner diameters of the outer electrodes 404, such that a cavity is provided between the inner and outer electrodes 404, 406. The cavity between the inner and outer electrodes 404, 406 electrically insulates the inner electrodes 406 from the outer electrodes 404 when there is no liquid aerosol-forming substrate disposed in the cavity.

As shown in FIG. 7, the first inner and outer electrodes at the first inner side of the cartridge housing 401 are aligned with the second inner and outer electrodes at the second inner side of the cartridge housing 401. As such, the first and second outer electrodes 404 are substantially separated by the width of the liquid storage portion, forming a cavity 408, and the first and second inner electrodes 406 are also substantially separated by the cavity 408 formed by the width of the liquid storage portion.

When liquid aerosol-forming substrate is disposed in the liquid storage portion, the liquid aerosol-forming substrate may be disposed in the cavity 408 and contact the first and second electrodes 404, 406. In this embodiment, the liquid aerosol-forming substrate is free to move in the liquid storage portion. However, in other embodiments, a carrier material may be provided in the liquid storage portion for holding the liquid aerosol-forming substrate. Such a carrier material is typically a porous, electrically insulating material that is disposed in the cavity 408, in contact with the inner and outer electrodes 404, 406.

As shown in FIG. 7, each of the outer electrodes 404 is electrically connected to control electronics 410 of an aerosol-generating device. Similarly, each of the inner electrodes 406 is electrically connected to the control electronics 410 of the aerosol-generating device. Each electrode 404, 406 is electrically connected to the control electronics 410 by one electrical contact.

The control electronics 410 are configured to supply an alternating voltage to the outer electrodes 404, which may drive an alternating current through liquid aerosol-forming substrate disposed in the cavity 408 between the first and second outer electrodes 404. The control electronics are configured to measure the current between the first and second outer electrodes 404.

The alternating current being driven by the control electronics 410 between the first and second outer electrodes 404 establishes an alternating voltage between the first and second inner electrodes 406. The control electronics 410 are configured to measure the voltage across the first and second inner electrodes. The control electronics are further configured to use the measurements of current and voltage to determine the electrical conductivity of the liquid aerosol-forming substrate disposed in the cavity 408. The control electronics 410 may further determine the concentration of nicotine in the liquid aerosol-forming substrate based on the determined electrical conductivity.

It will be appreciated that in other embodiments the four-point conductivity sensor 400 may be replaced with a two-point conductivity sensor having a first electrode at a first side of a liquid storage portion and a second electrode at a second side of the liquid storage portion.

In this embodiment, the conductivity sensor 400 is arranged in a liquid storage portion of a cartridge; however, it will be appreciated that in other embodiments the conductivity sensor 400 may be arranged in a liquid storage portion of an aerosol-generating device or in a conduit between a liquid storage portion and an atomiser.

FIGS. 9 and 10 show schematic illustrations of another exemplary conductivity sensor 500. In this embodiment, the conductivity sensor 500 is not combined with an atomiser. In this embodiment, the conductivity sensor 500 is an inductive conductivity sensor that is arranged in a liquid storage portion of a cartridge of an aerosol-generating device.

The conductivity sensor 500 comprises two electrodes 504, 506 in the form of toroidal coils. A first one of the coil electrodes is a driving coil 504, wound around a first ring 505 of ferromagnetic material. A second one of the coil electrodes is a receiving coil 506, wound around a second ring 507 of ferromagnetic material. The receiving coil 506 and ring 507 are substantially identical to the driving coil 504 and ring 505, in particular having the same number of turns and being wound in the same direction.

Each of the driving coil 504 and the receiving coil 506 has an inner cavity through which aerosol-forming substrate may flow. The receiving coil 506 is aligned with the driving coil 504 on an axis, and spaced from the driving coil 504 along the axis, such that the receiving coil inner cavity and the driving coil inner cavity are aligned to substantially form a continuous cylindrical inner cavity through which liquid aerosol-forming substrate may flow. The driving coil 504 is arranged and configured to induce a current in the receiving coil 506 when an alternating voltage is supplied to the driving coil 504.

Each end of the driving coil 504 and the receiving coil 506 is electrically connected to control electronics 510 of the aerosol-generating device.

The driving coil 504 and ferromagnetic ring 505 and receiving coil 506 and ferromagnetic ring 507 are embedded in an annular cylindrical body 512 of electrically insulating material, such as a plastics material, that is substantially impervious to the liquid aerosol-forming substrate. Accordingly, the body 512 has the form of a cylindrical tube having an inner cavity 514 that extends through the body 512 and is open at both ends. The body 512 is provided to protect the coil electrodes from the liquid aerosol-forming substrate. The body 512 is configured to be arranged in the liquid storage portion of the cartridge such that liquid aerosol-forming substrate in the liquid storage portion is able to flow through the inner passage 514 and around the outer surfaces of the body 501.

In use, the control electronics 510 are configured to supply power to the driving coil 504 in the form of an alternating voltage. The alternating voltage in the driving coil 504 creates a magnetic field that induces a current in the liquid aerosol-forming substrate disposed in the inner cavity 514. A current in the inner cavity 514 is shown by the arrow 516 in FIG. 7. The induced current 516 in the liquid aerosol-forming substrate also generates a magnetic field which induces a current in the receiving coil 506. The electrical conductivity of the liquid aerosol-forming substrate affects the magnitude of the current 516 induced in the liquid aerosol-forming substrate, which in turn affects the magnitude of the current induced in the receiving coil 506. The control electronics 510 are configured to measure one or both the voltage and the current induced in the receiving coil and are further configured to determine the electrical conductivity of the liquid aerosol-forming substrate based on one or more of the measured induced current and voltage in the receiving coil. The control electronics may further determine the concentration of nicotine in the liquid aerosol-forming substrate based on the determined electrical conductivity.

The invention claimed is:

1. An aerosol-generating system comprising:

a liquid storage portion for holding a liquid aerosol-forming substrate;

an atomiser in fluid connection with the liquid storage portion;

a conductivity sensor arranged to sense the electrical conductivity of liquid aerosol-forming substrate from the liquid storage portion, the conductivity sensor comprising at least two electrodes;

a power supply; and control electronics configured to:

control a supply of power from the power supply to the atomiser for atomising liquid aerosol-forming substrate from the liquid storage portion;

control a supply of power from the power supply to the electrodes of the conductivity sensor, the supply of power being provided to the conductivity sensor as an alternating voltage;

receive one or more measurements indicative of the conductivity of the liquid aerosol-forming substrate from the conductivity sensor; and determine the nicotine concentration of the liquid aerosol-forming substrate based on one or more of the measurements from the conductivity sensor, wherein the control electronics are configured to control the supply of power from the power supply to the atomiser for atomising the liquid aerosol-forming substrate based on the determined nicotine concentration of the liquid aerosol-forming substrate by comparing the determined nicotine concentration to a predetermined threshold, supplying a first power to the atomiser when the determined nicotine concentration is equal to or below the predetermined threshold and supplying a second power to the atomiser, lower than the first power, when the determined nicotine concentration exceeds the predetermined threshold.

2. The aerosol-generating system as claimed in claim 1, wherein the aerosol-generating system further comprises a heater arranged to heat aerosol-forming substrate from the liquid storage portion, and wherein the control electronics are configured to supply power from the power supply to the heater to heat liquid aerosol-forming substrate from the liquid storage portion to a predetermined temperature.

3. The aerosol-generating system as claimed in claim 1, wherein:

the system further comprises a temperature sensor arranged to sense the temperature of liquid aerosol-forming substrate from the liquid storage portion; and the control electronics are further configured to:

receive one or more measurements of temperature of the liquid aerosol-forming substrate at the conductivity sensor from the temperature sensor; and adjust the determination of the nicotine concentration based on one or more of the temperature measurements.

4. The aerosol-generating system as claimed in claim 1, wherein each electrode of the conductivity sensor is arranged to contact liquid aerosol-forming substrate from the liquid storage portion.

5. The aerosol-generating system as claimed in claim 4, wherein the conductivity sensor comprises two electrodes, and wherein the two electrodes are spaced apart to form a cavity in which liquid aerosol-forming substrate from the liquid storage portion is disposed.

6. The aerosol-generating system as claimed in claim 5, wherein the atomiser is a thermal atomiser comprising a plurality of heating elements, and wherein each of the electrodes of the conductivity sensor is formed from a heating element of the atomiser.

7. The aerosol-generating system as claimed in claim 6, wherein the control electronics are further configured to:

supply a first power to the electrodes of the conductivity sensor for measuring the conductivity of the liquid aerosol-forming substrate; and supply a second power to the plurality of heating elements of the atomiser for atomising the liquid aerosol-forming substrate, the second power being greater than the first power.

8. The aerosol-generating system as claimed in claim 4, wherein:

the conductivity sensor comprises two inner electrodes and two outer electrodes;

the two outer electrodes are spaced apart to form an outer cavity in which liquid aerosol-forming substrate from the liquid storage portion is disposed;

the two inner electrodes are arranged in the outer cavity, between the two outer electrodes, and are spaced apart to form an inner cavity in which liquid aerosol-forming substrate from the liquid storage portion is disposed; and the control electronics are further configured to:

supply the power from the power supply to the outer electrodes, the supply of power being provided to the outer electrodes as an alternating voltage; and receive the one or more measurements indicative of the conductivity of the liquid aerosol-forming substrate from the inner electrodes.

9. The aerosol-generating system as claimed in claim 8, wherein the atomiser is a thermal atomiser comprising a plurality of heating elements, and wherein each of the electrodes of the conductivity sensor is formed from a heating element of the atomiser.

10. The aerosol-generating system as claimed in claim 9, wherein the control electronics are further configured to:

supply a first power to the outer electrodes of the conductivity sensor for measuring the conductivity of the liquid aerosol-forming substrate; and supply a second power to the plurality of heating elements of the atomiser for atomising the liquid aerosol-forming substrate, the second power being greater than the first power.

11. The aerosol-generating system as claimed in claim 1, wherein the conductivity sensor comprises two electrodes, a first electrode and a second electrode, each electrode forming a coil, wherein the control electronics are configured to supply the alternating voltage to the first electrode and the control electronics are configured to receive the one or more measurements indicative of the conductivity of the liquid aerosol-forming substrate from the second electrode, and wherein the first electrode is arranged to induce a current in the second electrode when the alternating voltage is supplied to the first electrode.

12. The aerosol-generating system as claimed in claim 11, wherein the first electrode and the second electrode are arranged in the liquid storage portion.

13. An aerosol-generating system comprising:

a liquid storage portion for holding a liquid aerosol-forming substrate comprising nicotine;

an atomiser in fluid connection with the liquid storage portion;

a conductivity sensor arranged to sense the electrical conductivity of liquid aerosol-forming substrate from the liquid storage portion, the conductivity sensor comprising at least two electrodes;

a power supply; and control electronics configured to control an amount of nicotine in a quantity of atomized liquid aerosol-forming substrate delivered to a user, wherein the control electronics are configured to:

control a supply of power from the power supply to the electrodes of the conductivity sensor, the supply of power being provided to the conductivity sensor as an alternating voltage;

receive one or more measurements indicative of the conductivity of the liquid aerosol-forming substrate from the conductivity sensor; and control a supply of power from the power supply to the atomiser for atomising liquid aerosol-forming substrate from the liquid storage portion based on the one or more measurements indicative of the conductivity of the liquid aerosol-forming substrate from the conductivity sensor, thereby controlling the amount of nicotine in the quantity of atomized liquid aerosol-forming substrate delivered to the user.

14. An aerosol-generating system as claimed in claim 13, wherein the control electronics are configured to control a supply of power from the power supply to the atomiser for atomising liquid aerosol-forming substrate from the liquid storage portion based on the one or more measurements indicative of the conductivity of the liquid aerosol-forming substrate from the conductivity sensor by:

determining a nicotine concentration of the liquid aerosol-forming substrate based on one or more measurements indicative of the conductivity of the liquid aerosol-forming substrate from the conductivity sensor; and comparing the determined nicotine concentration to a predetermined threshold.

15. An aerosol-generating system as claimed in claim 13, wherein the control electronics are configured to control a supply of power from the power supply to the atomiser for atomising liquid aerosol-forming substrate from the liquid storage portion based on the one or more measurements indicative of the conductivity of the liquid aerosol-forming substrate from the conductivity sensor by;

determining a nicotine concentration of the liquid aerosol-forming substrate based on one or more measurements indicative of the conductivity of the liquid aerosol-forming substrate from the conductivity sensor; and controlling the power supplied from the power supply to the atomiser in discrete increments, wherein a plurality of discrete power settings are stored in a look-up table in a memory of the control electronics, each power setting being associated with a particular predetermined nicotine concentration and electrical conductivity, and the control electronics are configured to compare a conductivity measurement to the stored electrical conductivity values in the look-up table and apply power from the power supply to the atomiser based on the power setting associated with the stored electrical conductivity value that matches the conductivity measurement.

* * * * *